US008079170B2

(12) United States Patent
Loftin

(10) Patent No.: US 8,079,170 B2
(45) Date of Patent: Dec. 20, 2011

(54) GUN BARREL CLEANING APPARATUS AND METHOD

(76) Inventor: Thomas E. Loftin, Alpine, CA (US)

( * ) Notice: Subject to any disclaimer, the term of this patent is extended or adjusted under 35 U.S.C. 154(b) by 56 days.

(21) Appl. No.: 12/549,717

(22) Filed: Aug. 28, 2009

(65) Prior Publication Data

US 2011/0047852 A1 Mar. 3, 2011

(51) Int. Cl.
*F41A 29/02* (2006.01)

(52) U.S. Cl. ..... 42/95; 15/104.03

(58) Field of Classification Search ... 42/95; 15/104.16, 15/104.03, 104.05, 104.062, 104.14
See application file for complete search history.

(56) References Cited

U.S. PATENT DOCUMENTS

| | | | | | |
|---|---|---|---|---|---|
| 937,729 | A | * | 10/1909 | Upham | 15/104.2 |
| 4,599,173 | A | * | 7/1986 | Berger | 210/451 |
| 4,866,871 | A | * | 9/1989 | Rivers | 42/95 |
| 4,901,465 | A | * | 2/1990 | Hsu | 42/95 |
| 5,202,523 | A | * | 4/1993 | Grossman et al. | 42/95 |
| 5,628,136 | A | | 5/1997 | Wickser, Jr. | |
| 5,743,040 | A | * | 4/1998 | Kennedy | 42/95 |
| 5,775,020 | A | * | 7/1998 | Baird | 42/95 |
| 5,815,975 | A | * | 10/1998 | Rambo et al. | 42/95 |
| 5,983,550 | A | * | 11/1999 | Skaar | 42/95 |
| 6,023,873 | A | * | 2/2000 | Baird | 42/95 |
| 6,269,579 | B1 | | 8/2001 | Warner | |
| 6,389,978 | B1 | | 5/2002 | Hooper et al. | |
| 6,463,944 | B2 | | 10/2002 | Heiberg et al. | |
| 6,536,152 | B1 | | 3/2003 | Wisz | |
| 6,591,732 | B2 | | 7/2003 | Gerber et al. | |
| RE38,247 | E | | 9/2003 | Wickser, Jr. | |
| 6,640,480 | B2 | | 11/2003 | Williams et al. | |
| 6,668,480 | B1 | | 12/2003 | Riley | |
| 6,691,446 | B2 | | 2/2004 | Graves | |
| 6,701,657 | B1 | * | 3/2004 | Hudspeth | 42/95 |
| 6,701,658 | B1 | | 3/2004 | Brownell | |
| 6,722,378 | B2 | | 4/2004 | Heiberg et al. | |
| 6,761,101 | B1 | | 7/2004 | Luth | |
| 6,922,933 | B1 | | 8/2005 | Davis | |
| 6,981,345 | B1 | | 1/2006 | Gunn et al. | |
| 7,005,278 | B2 | | 2/2006 | Danenberg | |
| 7,020,994 | B2 | | 4/2006 | Buie, II | |
| 7,030,306 | B1 | | 4/2006 | Chang | |
| 7,055,279 | B2 | | 6/2006 | Flores | |
| 7,073,286 | B2 | | 7/2006 | Paananen et al. | |
| 7,131,229 | B1 | | 11/2006 | Davis | |
| 7,356,961 | B2 | | 4/2008 | Williams | |
| 7,367,151 | B1 | | 5/2008 | Black et al. | |
| 2002/0056219 | A1 | | 5/2002 | Solberg et al. | |
| 2004/0244627 | A1 | | 12/2004 | Bice et al. | |
| 2007/0261288 | A1 | | 11/2007 | Perry et al. | |

* cited by examiner

*Primary Examiner* — Benjamin P Lee
(74) *Attorney, Agent, or Firm* — Greenberg Traurig LLP; Franklin D. Ubell

(57) ABSTRACT

A gun barrel cleaning tool for receiving and enclosing a gun barrel while guiding a cleaning brush back and forth through the enclosed gun barrel. Cleaning fluid is introduced through a suitable passage way into the interior of the apparatus and a cleaning brush may thereafter be passed back and forth through an enclosed gun barrel in order to clean it.

33 Claims, 20 Drawing Sheets

GUN BARREL CLEANING APPARATUS AND METHOD

BACKGROUND

1. Field

The subject disclosure relates to methods and apparatus for cleaning gun barrels.

2. Related Art

In the past, apparatus for cleaning gun barrels has traditionally included a wire brush and a bottle of cleaning solvent.

SUMMARY

The following is a summary description of illustrative embodiments of the invention. It is provided as a preface to assist those skilled in the art to more rapidly assimilate the detailed design discussion which ensues and is not intended in any way to limit the scope of the claims which are appended hereto in order to particularly point out the invention.

According to illustrative embodiments, a gun barrel cleaning tool is provided comprising apparatus for receiving and enclosing a gun barrel while guiding a cleaning brush back and forth through the gun barrel. Cleaning fluid is introduced through a suitable passage way into the interior of the apparatus and a cleaning brush may thereafter be passed back and forth through an enclosed gun barrel in order to clean it. Excess fluid is captured in a fluid reservoir attached at one end of the device.

In one embodiment, the apparatus includes a barrel holder component pivotally mounted to a brush guide component and a sleeve positionable in an interior chamber of the barrel holder, the sleeve being shaped and dimensioned to hold a gun barrel. The brush guide component has an opening therein at an end opposite from the fluid reservoir which permits insertion of the brush into the cleaning tool. In such an embodiment, the barrel holder may have first and second side rails and the brush guide may further have first and second slots disposed to slidably mate with the respective side rails. The brush guide may further comprise an upper housing having a cylindrical chamber and an undercarriage fastenable to the upper housing component.

In another embodiment, the gun cleaning tool comprises a lower housing section, and a handle attached to a hinged cover, the cover including a sleeve for holding a gun barrel, the cover further being shaped and dimensioned to mate with the lower housing section so as to entirely encapsulate the gun barrel. A fluid reservoir is again attached at one end of the device and entry way for a cleaning brush provided at the opposite end.

Many additional features, embodiments and advantages thereof are hereafter disclosed in more detail.

DRAWINGS

The features and advantages of the present disclosure will become more apparent with reference to the following description taken in conjunction with the accompanying drawings wherein like reference numerals denote like elements and in which.

DETAILED DESCRIPTION

Figure 1:
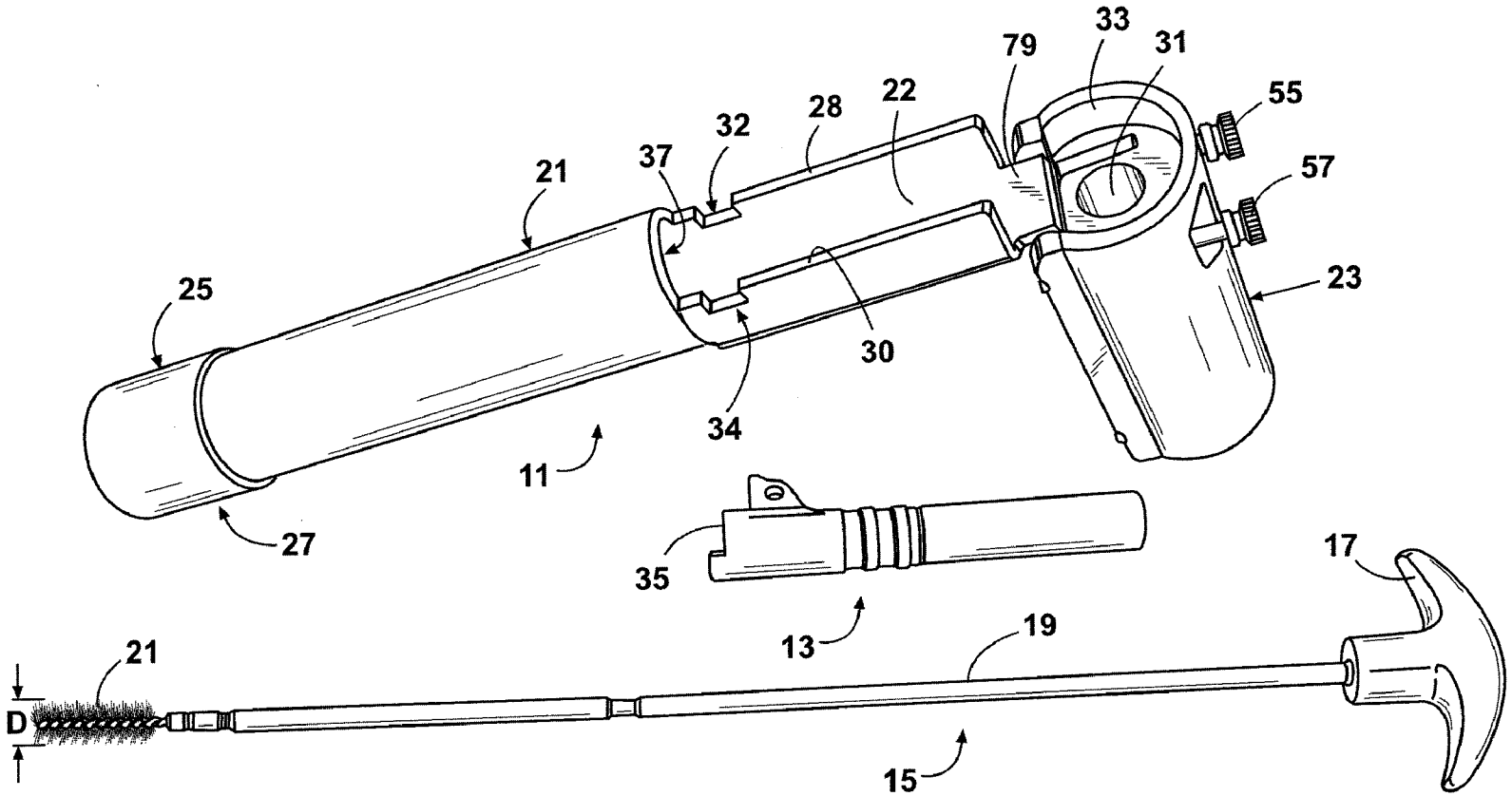
FIG. 1 is a perspective view illustrating a gun barrel and related gun barrel cleaner apparatus according to an illustrative embodiment.

An illustrative embodiment of a gun barrel cleaner tool 11 is shown in FIG. 1. Also illustrated is a gun barrel 13 and a conventional wire brush barrel cleaning tool 15, which comprises a handle 17, a rod 19, and a wire brush 21. The wire brush 21 screws onto one end of the rod 19, while the handle 17 screws on to the opposite end of the rod 19.

Figure 2:
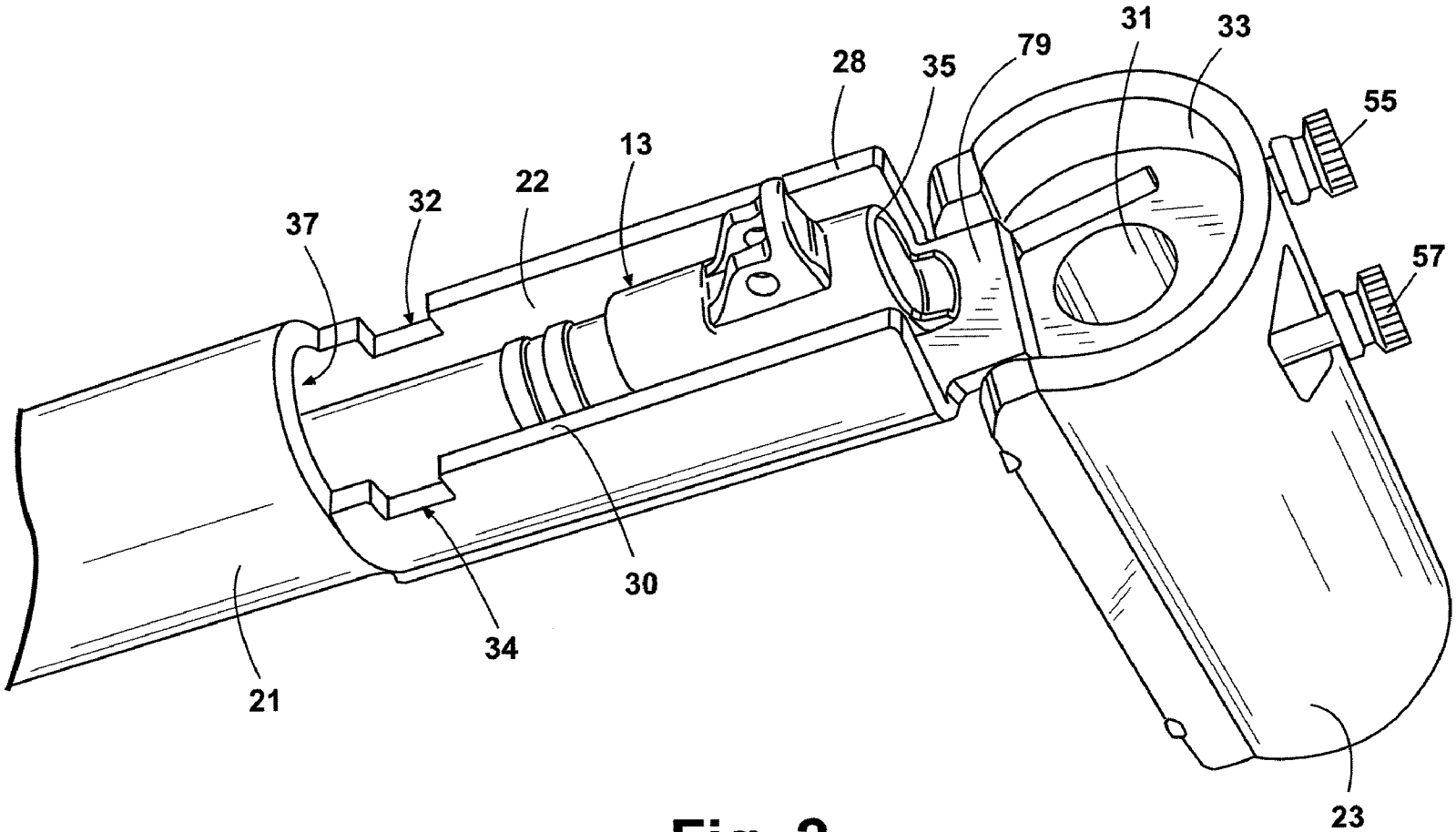
FIG. 2 is a perspective view of a portion of an illustrative gun barrel cleaning device in an open position.
Figure 3:
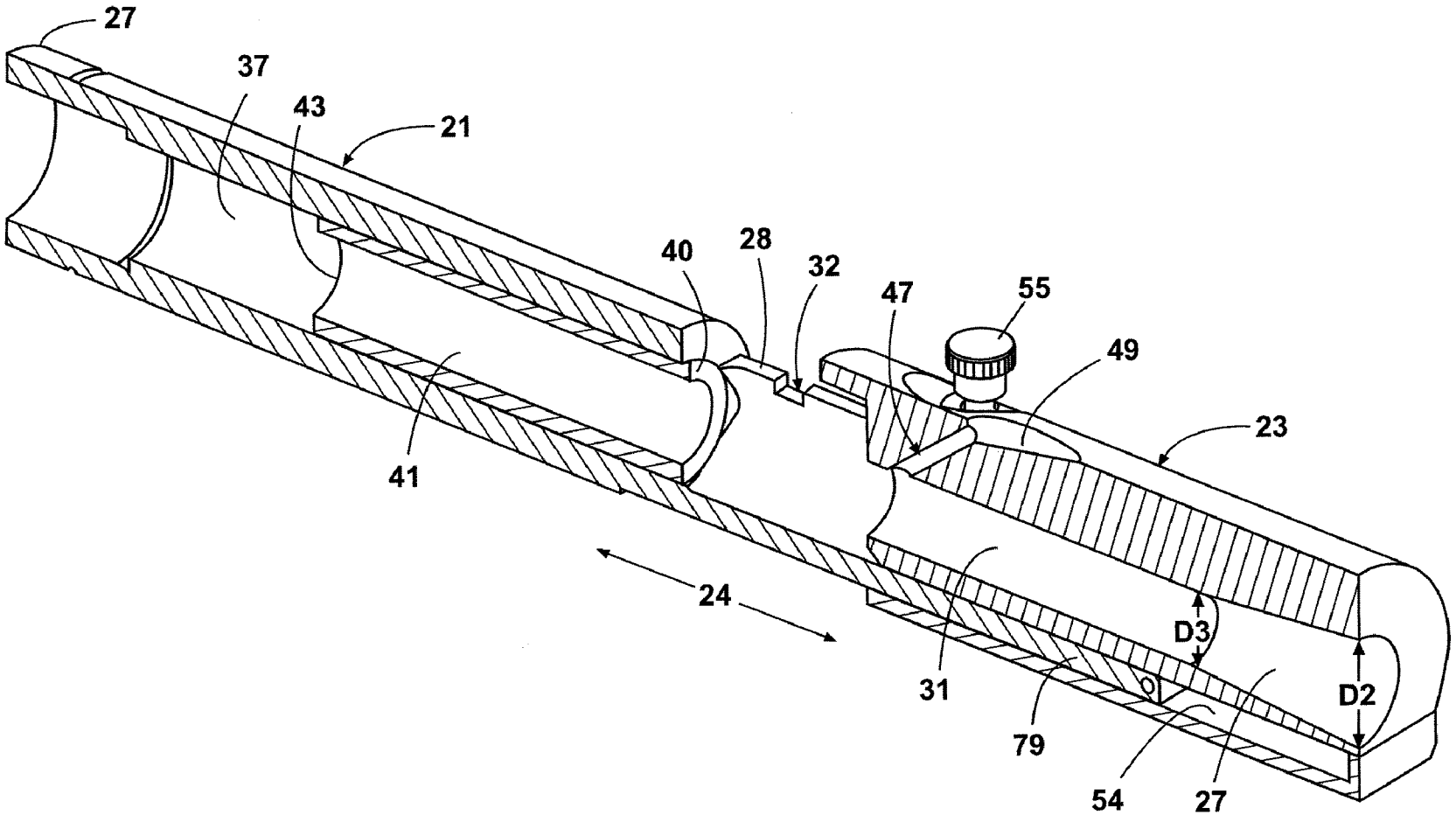
FIG. 3 is a perspective sectional view of the device of FIG. 2 in a partially closed position.
Figure 4:
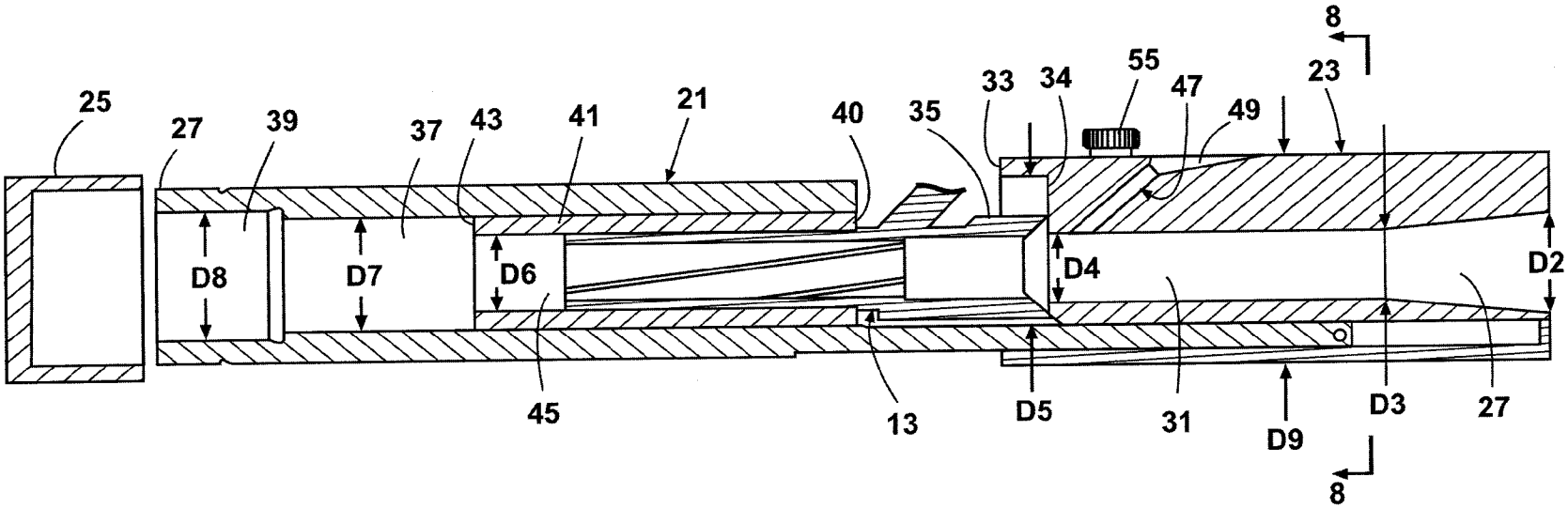
FIG. 4 is a side sectional view of the device of FIG. 2 in the partially closed position of FIG. 3.

As shown in FIG. 1-5, the gun barrel cleaner tool 11 includes a barrel holder 21 pivotally mounted to a rear brush guide 23. An opening or cradle 22 is provided in the barrel holder 21 to facilitate insertion of a gun barrel, e.g. 13, into a first interior chamber 37. As seen in FIG. 4, the first inner chamber 37 is cylindrical of a diameter $D_7$ and opens into a second cylindrical chamber 39 of larger diameter D8. In one embodiment, the diameters $D_7$ and $D_8$, may be 0.875 inches and 1.10 inches respectively.

FIG. 2 illustrates a gun barrel, e.g. 13, after insertion into the cradle 22. The cradle 22 has oppositely disposed parallel top slide rails 28, 30, with respective notches 32, 34 formed therein. A rectangular tongue 79 extends from the end of barrel holder 21 and has oppositely disposed pins 75, 77 formed thereon, as shown, e.g. in FIG. 6. Alternatively, a single metal pin could be substituted for the two oppositely disposed pins 75, 77.

Referring back to FIG. 1, a removable end cap 25, which serves as a cleaning fluid reservoir, is attached at one end 27 of the tool 11. The end cap 25 may press-fit on to the end 27 or alternatively be screwed on, via cooperating threads formed on the interior of the cap 25 and the outside surface or exterior of the end 27 of the barrel holder 21. Alternatively, an end cap could be designed to thread into the second chamber 39 at the end 27. Optionally, a petcock may be provided in the end cap 25 to control removal of fluid from the end cap 25.

In one embodiment, a barrier may also be provided to inhibit fluid backwash toward the user. Such a barrier may be a flat machine type washer about ⅛ of an inch thick, formed, for example, out of plastic. A ⅛ inch thick washer has a cone shaped design added to it, in the middle. In one embodiment, the height of the cone may be about ½ of an inch. The opening at the small end or tip of the cone matches the diameter D6 of FIG. 4. The diameter of the opening in the tip of the cone is just large enough to allow the cleaning brush bristles to pass by without touching the cone (if the bristles happened to extend that far down the device). Such a barrier or washer would be "captured or pinched" between the bottle 25 and the barrel holder 21 of FIG. 4 with the direction of the tip of the cone oriented toward the bottom of the bottle, allowing fluids to run into the bottle but not return down the barrel easily. The barrier or washer thus acts as trap to keep the majority of the fluids in the bottle 25 while allowing the fluids to move from the chamber D8 into the bottle 25.

As illustrated in FIGS. 3 and 4, within the gun barrel chamber 37 is mounted a sleeve or "barrel insert" 41, which has a cylindrical outer surface 43 and a cylindrical interior opening 45 having a constant diameter $D_6$. After insertion into the cradle 22 as shown in FIG. 2, the gun barrel 13 is pushed into the sleeve 41 to the position shown in FIG. 4.

Figure 13:
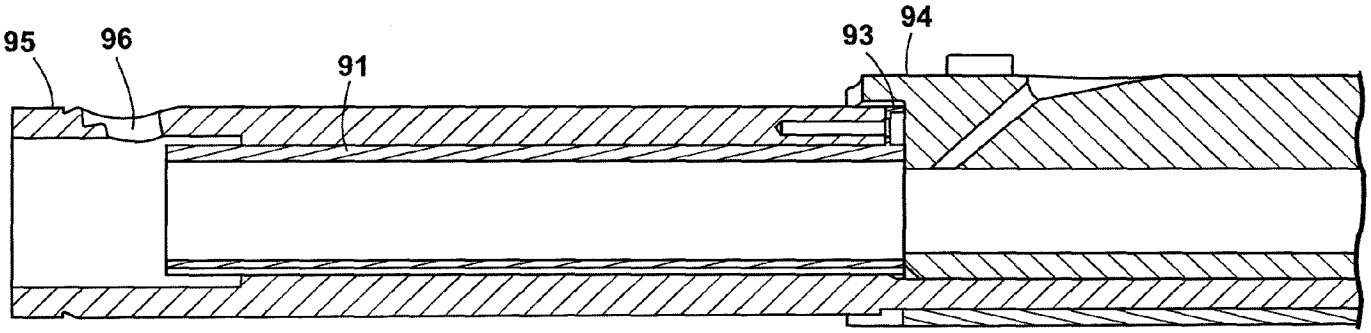
FIG. 13 is a side sectional view illustrating additional features implementable in gun cleaning tools constructed according to the illustrative embodiments.

In an alternate embodiment shown in FIG. 13, the length of the insert 41 is increased such that the insert extends, for example, ½ inch into the second cylindrical chamber 39, which allows the bristles 21 of the wire brush 15 to ride against the interior of the insert 41 for a pre-determined length before the bristles are drawn up into the barrel 13. In this alternative embodiment, the larger diameter $D_8$ of the second chamber 39 forms a trap which keeps small amounts of fluid from rushing back toward the user's face, if the user were to hold the bottle end upward for inspection to determine whether the barrel is clean or needs more agitation.

The sleeve or barrel insert 41 may be formed of a soft plastic, such as, for example, urethane or silicone of, for example, approximately "SHORE 75 A" softness so as not to scratch the precision machined barrel surfaces. Sleeves 41 of different inside diameters $D_6$ may be provided to accommodate various size gun barrels, for example, such as 17, 22, 38, or 45 caliber, or 9 millimeter. Thus, in one embodiment, the barrel inserts 41 all have the same outer diameter but the inner dimensions are specific to each barrel's outer diameter, plus or minus approximately 0.007 inches. The interior of the sleeve 41 may be knurled or otherwise made irregular in order to better grip the gun barrel 13. A groove may also be formed down the entire length of the underside of the sleeve 41 to facilitate fluid flow through the tool 11.

As shown in the cross-section of FIGS. 3 and 4, the brush guide 23 preferably includes a conically shaped entry way 27, which in one embodiment may be of a diameter $D_2$ of 0.800 inches at its mouth and a diameter $D_3$ of 0.525 inches at its interior end. In alternative embodiments, the diameter $D_3$ may be made smaller for smaller caliber barrels, e.g. down to 0.170 inches. The brush guide 23 further includes a cylindrical interior chamber 31 of diameter $D_4$=$D_3$, which opens into a wider cylindrical receptacle or bonnet 33, which in an illustrative embodiment may have a diameter $D_5$ of 1.435 inches. As may be seen in FIG. 4, the bonnet 33 overlaps the rear end 35 of the gun barrel 13 when the cleaner tool 11 is in a closed, operative position wherein vertical edge 34 of the brush guide 23 abuts the rear end 35 of the gun barrel 13. The outer diameter $D_9$ of the brush guide 23 may be 1.750 inches in one embodiment.

Figure 7:
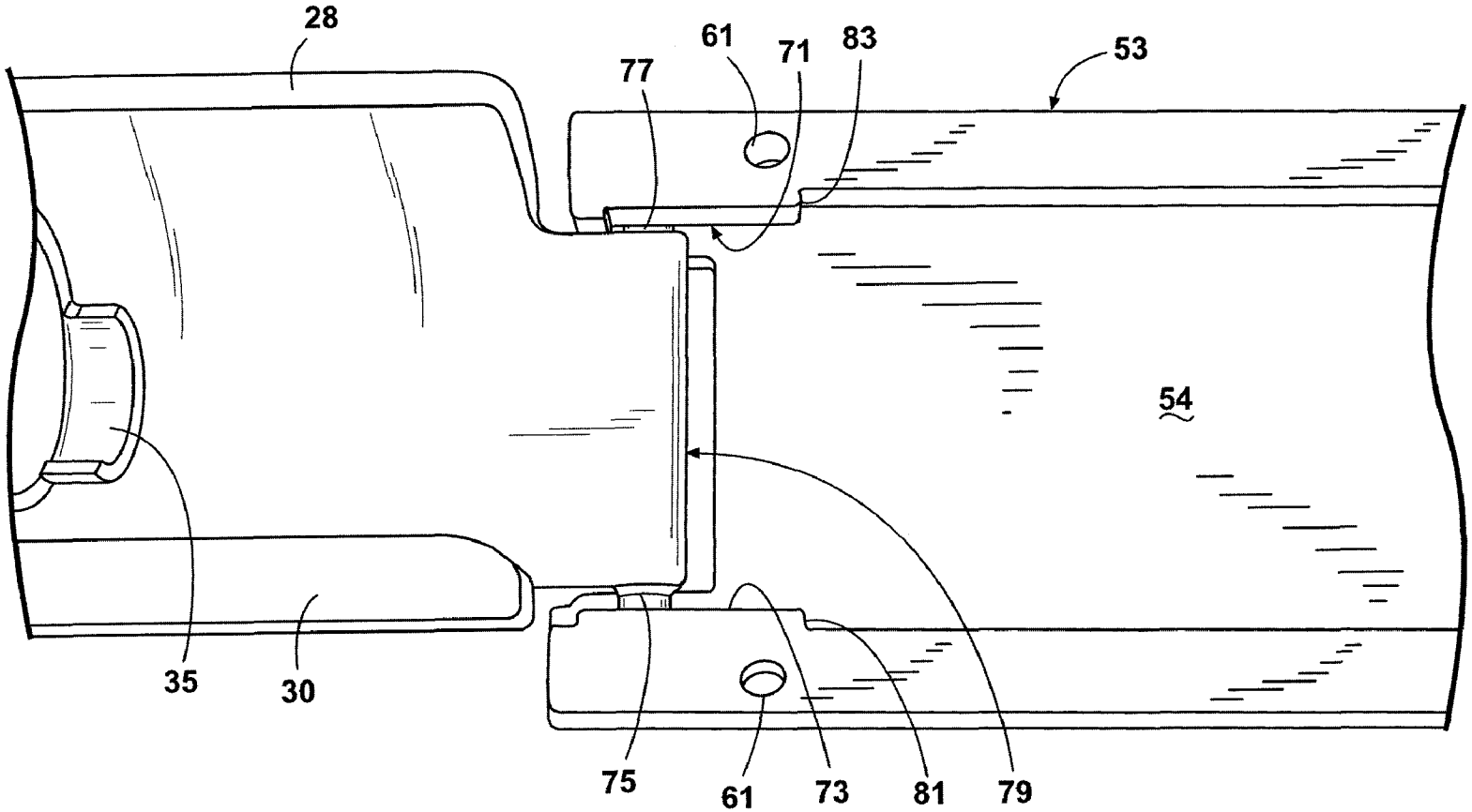
FIG. 7 is a top view illustrating assembly of the brush guide to the barrel holder of the illustrative embodiment.
Figure 8:
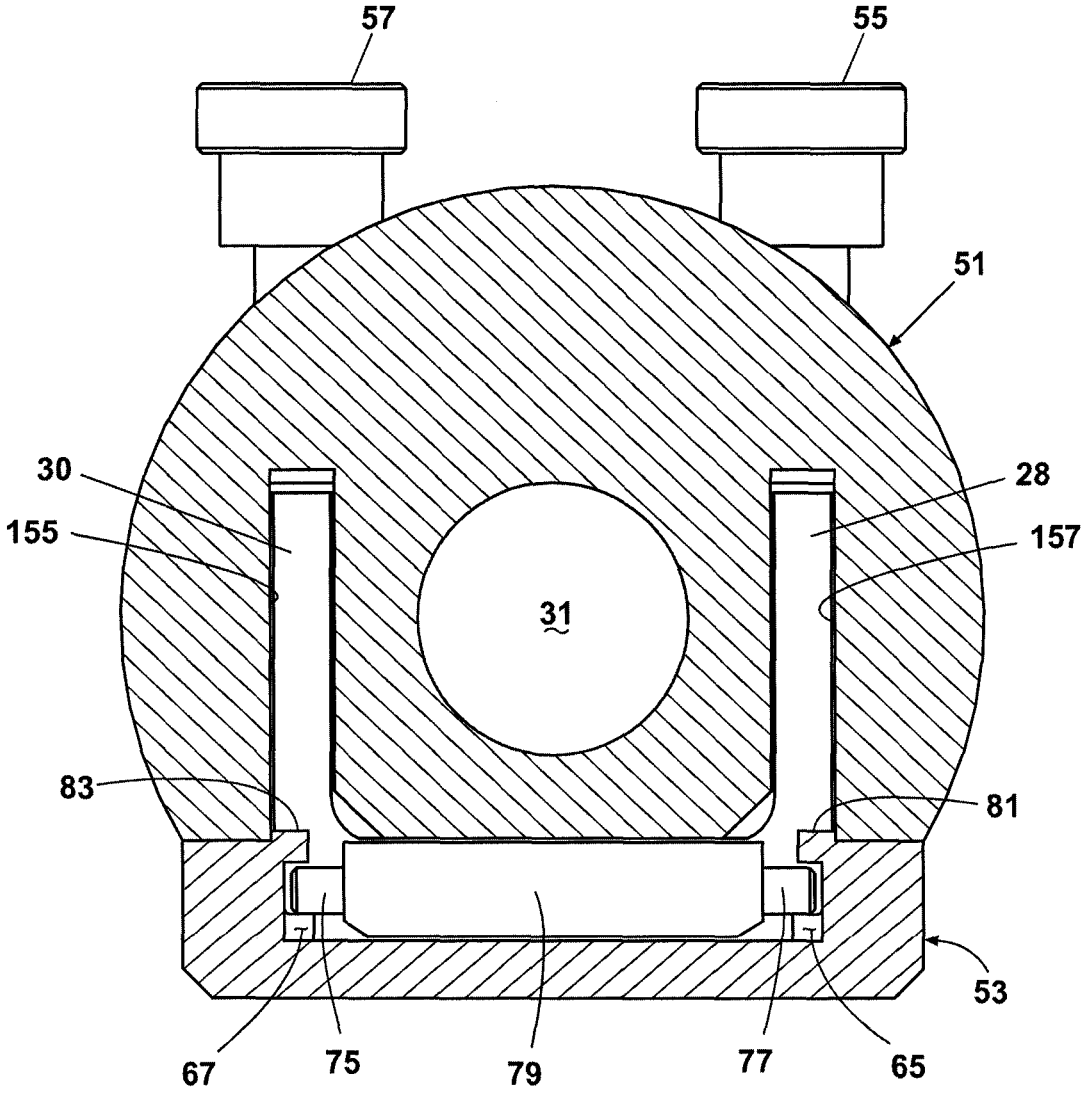
FIG. 8 is an enlarged cross-sectional view taken at 8-8 of FIG. 4.
Figure 9:
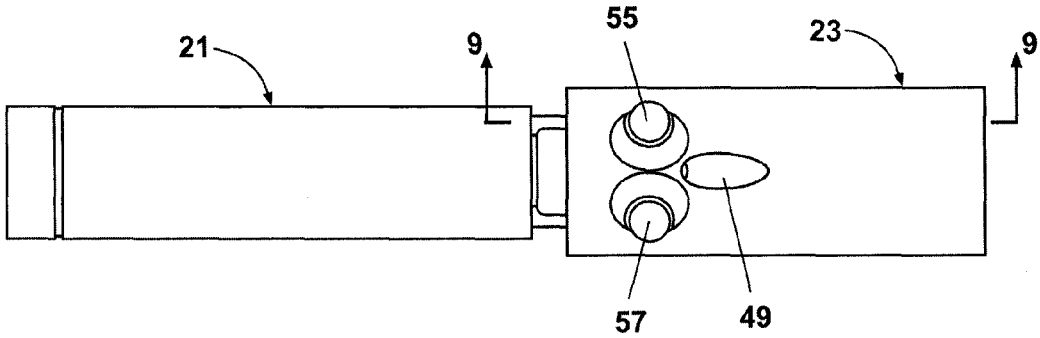
FIG. 9 is a top view of the illustrative embodiment in a partially closed position.

As may be appreciated, the brush guide 23 is arranged to move back and forth parallel to the central axis of the tool 11, as indicated by arrows 24 in FIG. 3. The structure which facilitates such motion in an illustrative embodiment is shown in FIGS. 6-8.

Figure 6:
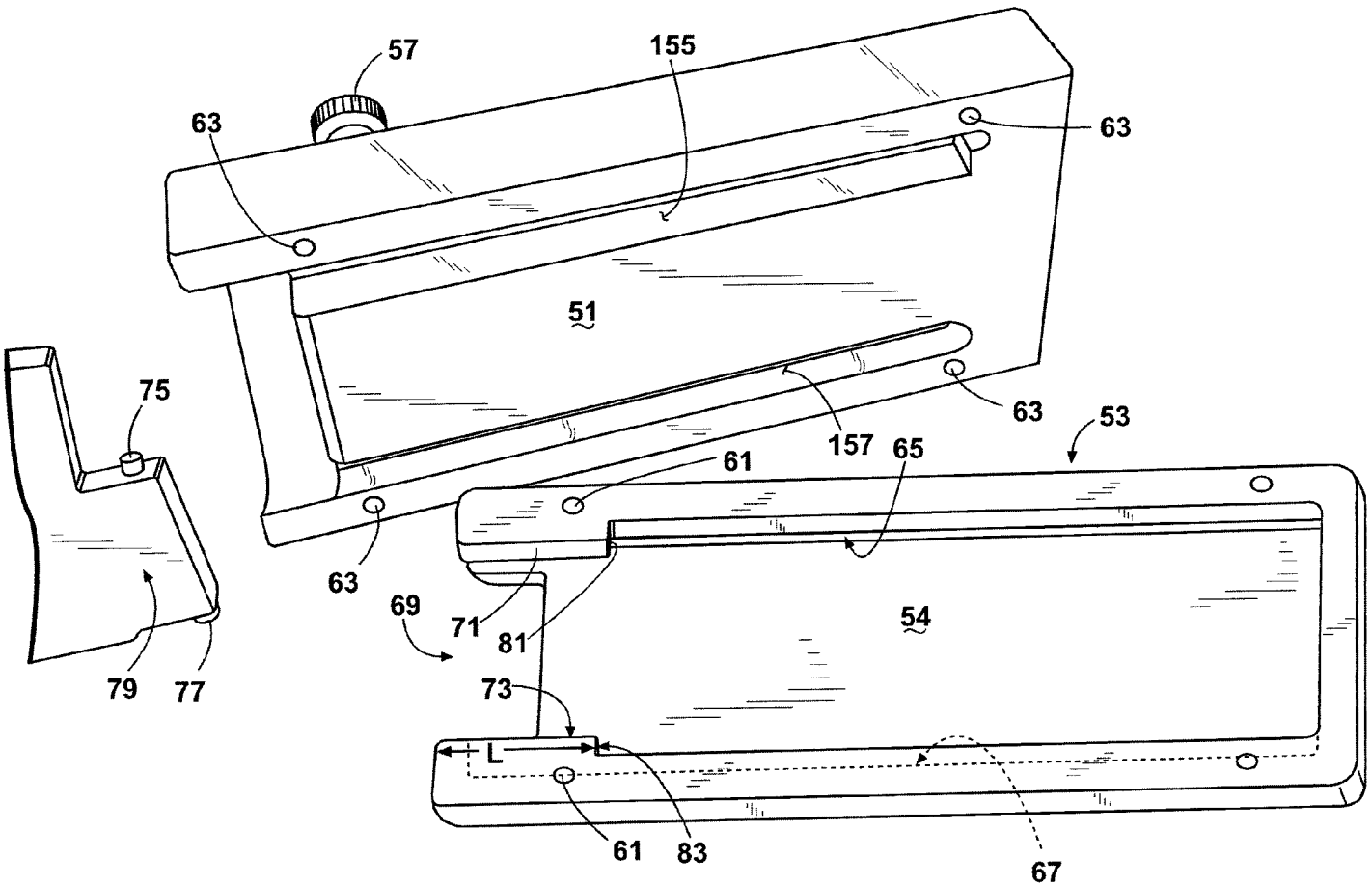
FIG. 6 is a perspective view illustrating the components of a brush guide component of an illustrative embodiment in a disassembled state.

As shown in FIG. 6, the brush guide 23 comprises an upper housing component 51 and an undercarriage 53. The upper housing component 51 contains parallel slots 155, 157, which are shaped and dimensioned to receive the respective slide rails 28, 30 of the barrel holder 21. During assembly, the undercarriage 53 is attached to the upper housing 51 by four screws or other fastening devices inserted through respective holes 61 in the undercarriage 53 and into cooperating aligned holes 63 in the upper housing 51. The components of the brush guide 23 and barrel holder 21 may be molded or otherwise formed of a suitable plastic.

The undercarriage 53 includes respective parallel slots 155, 157 formed in the opposite interior sides thereof. At the interior end 69 of the undercarriage 53, respective lips 71, 73 are formed, which may have a length "L" of, for example, 0.600 inches. The lips 71, 73 are sized and dimensioned such that the pins 75, 77 on the extending tongue portion 79 of the barrel holder 21 may each be placed behind the ends 81, 83 of the lips 71, 73, and then pulled forward in the slots 65, 67 to the position shown in FIG. 7, thereby pivotally mounting the undercarriage 53 with respect to the barrel holder 21. After the respective parts 79, 53 are pivotally attached as shown in FIG. 7, the upper housing 51 is fastened to the undercarriage 53 using the screws 59, thereby confining the tongue 79 to ride back and forth in the channel 54 of the undercarriage 53, while, at the same time, the slide rails 28, 30 slide in and out of the parallel slots 155, 157 of the upper housing component 51.

Figure 10:
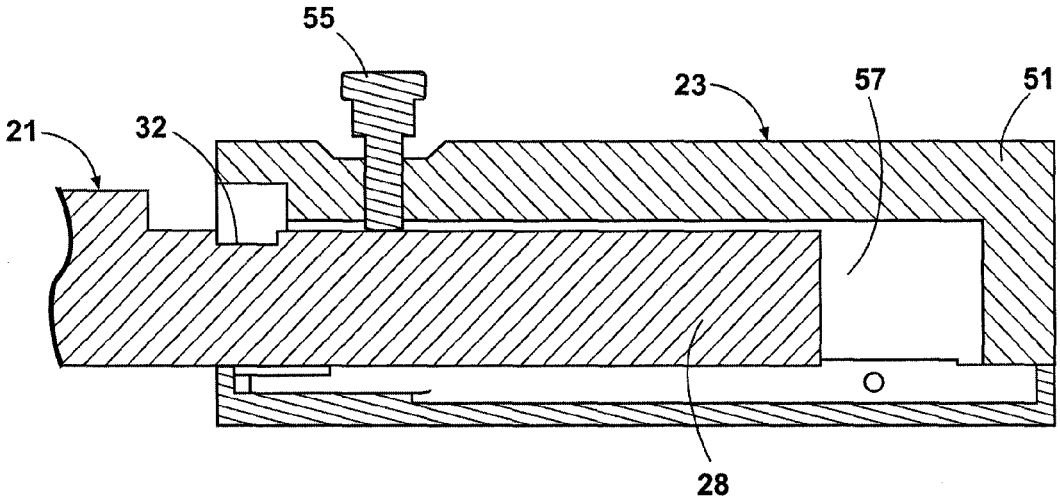
FIG. 10 is a side sectional view taken at 9-9 of FIG. 9.
Figure 11:
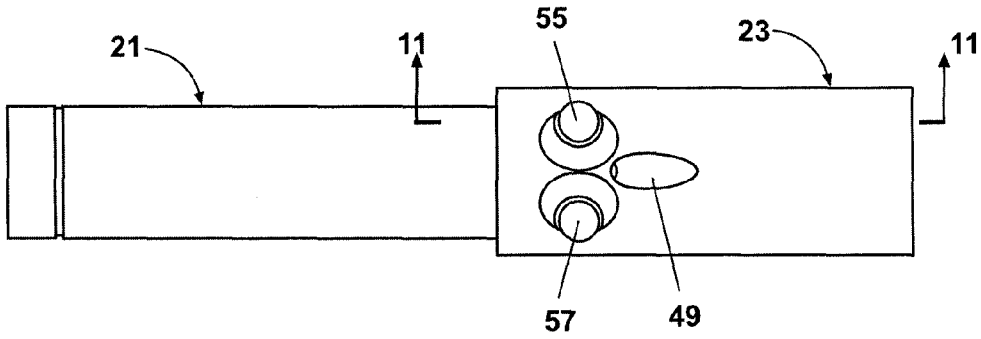
FIG. 11 is a top view of the illustrative embodiment in a closed position.
Figure 12:
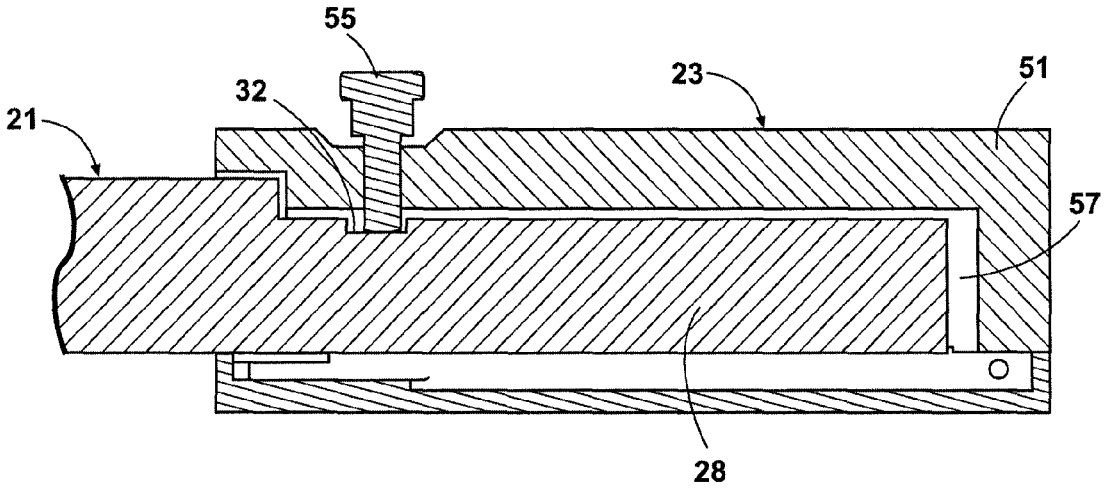
FIG. 12 is a side sectional view taken at 11-11 of FIG. 11.

FIG. 10 illustrates one of the slide rails 28 positioned in the interior of one of the upper housing member slots 157, in an open position of the device 11. In this position, the thumb screw 55 is clamped against the top edge of the slide rail 28, holding the slide rail 28 in an open position. In FIG. 12, the slide rail 28 has been pushed further into the upper housing 51 and is clamped into the closed position by screwing the thumb screw 55 down into the side rail notch.

As further illustrated, for example, in FIGS. 3 and 4, an eyedropper channel 47 with an enlarged entryway 49 is formed in the brush guide 23 and leads from the exterior of the brush guide 23 into the interior of the cylindrical chamber 31. As described later, the channel 47 receives an eyedropper fluid discharge tube for discharging chemical gun cleaner fluid into the interior of the cleaner device 11. Put barrel in close it up against the barrel. The diameter of the entry way 49 may be narrowed at the interior end, as shown in FIG. 13 in order to prevent the eyedropper tip from entering the chamber 31.

Figure 22:
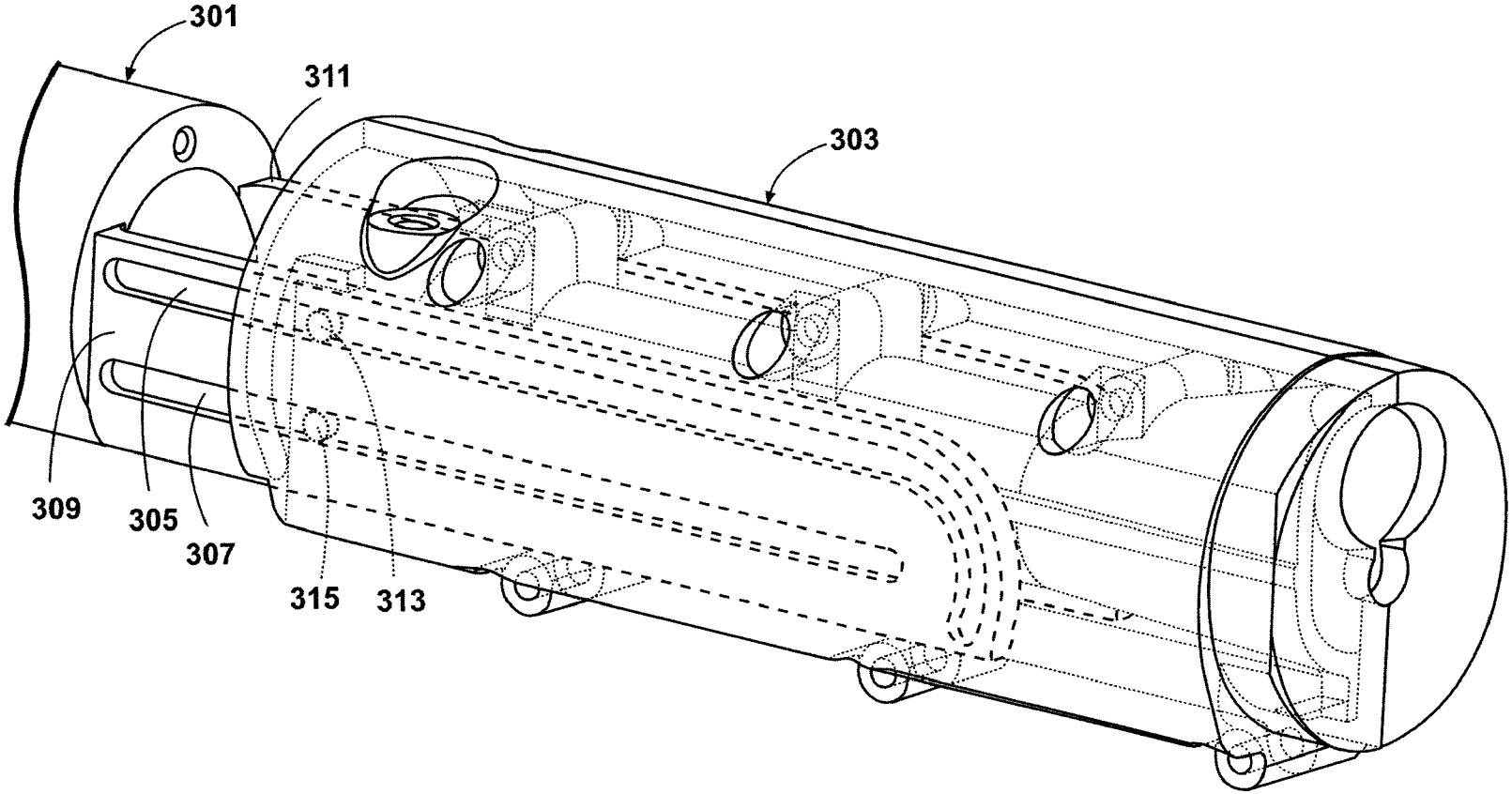
FIG. 22 is a perspective view of an alternative hinge mechanism.
Figure 23:
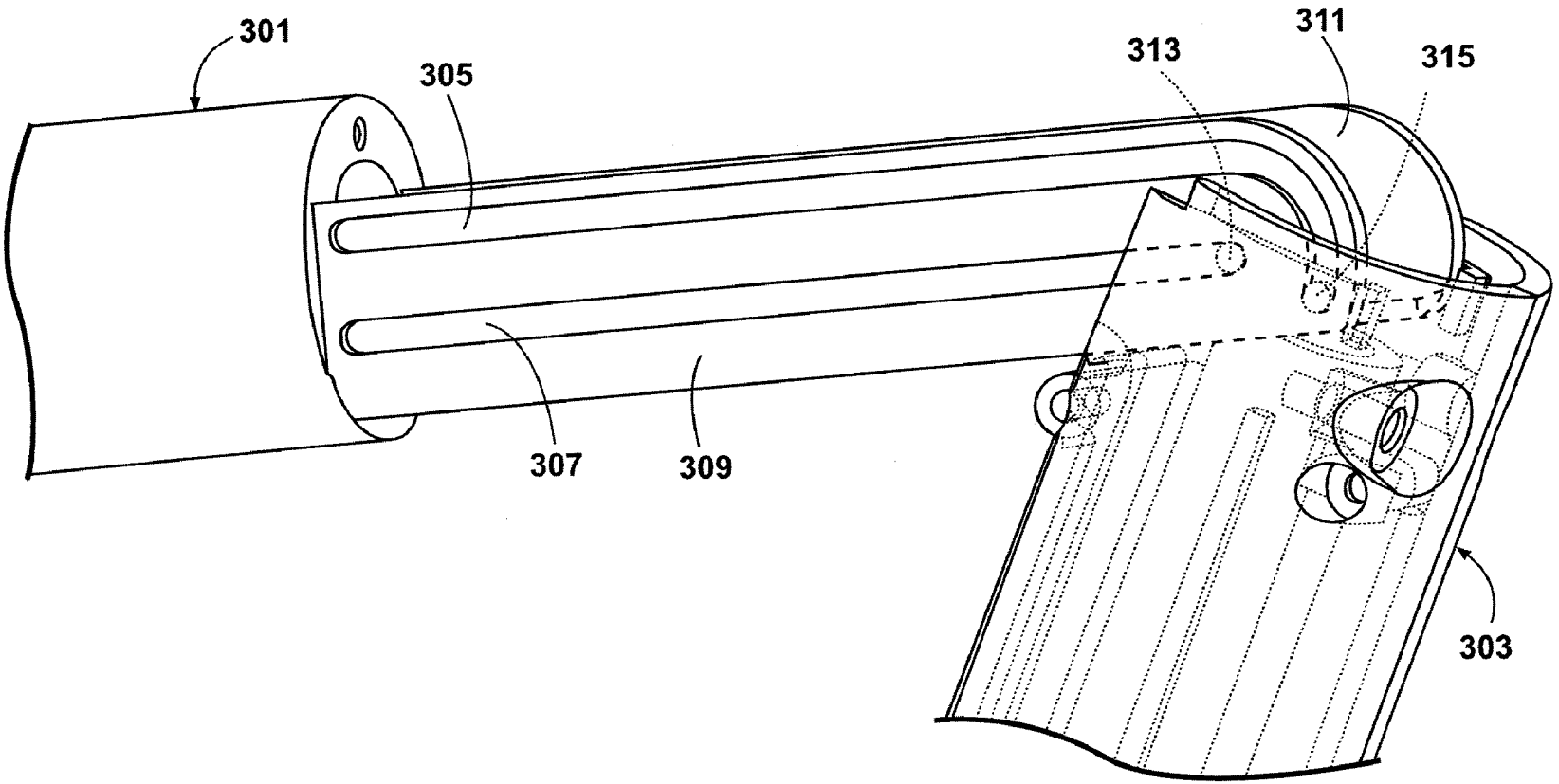
FIG. 23 is a perspective view of the alternative hinge mechanism of FIG. 22 in an open position.

An alternative and presently preferred hinge mechanism embodiment is illustrated in FIGS. 22 and 23. In this embodiment, slots 305, 307, are molded or otherwise formed in the sides 309, 311, of a barrel holder assembly 301. (The slots on side 311 are not shown but mirror the slots 305, 307). Pins 313, 315 are molded or otherwise formed on the interior surface of a guide assembly 303 and are positioned to travel in the respective slots 305, 307. At the far end of the barrel holder 301, the upper slot 305 curves arcuately downward, while the lower linear slot 307 terminates a short distance from the downward, curved portion of the upper slot 305. In this manner, the guide assembly is supported and directed as it moves rearwardly and assumes the fully open position shown in FIG. 23, analogous to the position shown in FIG. 2, for example.

Figure 14:
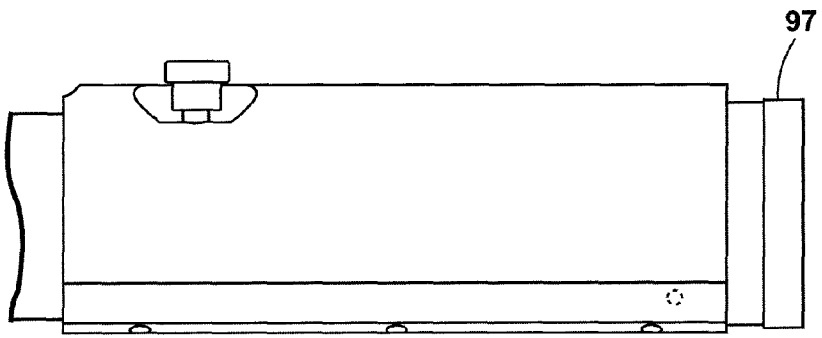
FIG. 14 is a fragmented side view illustrating additional features implementable in gun cleaning tools constructed according to the illustrative embodiments.

FIGS. 13-14 illustrate features implementable in various alternate embodiments. In particular, the barrel holder sleeve 91 of FIG. 13 includes a vertical extending portion or lip 93, which receives a screw 94, which serves to retain the sleeve 91 in the tool 11 while the barrel 13 is being extracted from the sleeve 91. The sleeve 91 has also been elongated to extend into the chamber 95 to trap fluid and prevent it from back-washing on the user. Additionally, a threaded hole 96 for installing a removable light, light collector, or other illumination device may be provided. Such a device assists the user in examining the interior of the barrel to ascertain whether it is clean.

An alternative is to use an illumination source fitted into the removable fluid bottle 25. In such embodiment, a hole is first punched (approximately ¼ inch in diameter) in the removable flexible vinyl bottle 25. The hole is located 0.875 inches from the edge of the open end of the vinyl. Starting in the fully seated position, the bottle 25 is slid away from the main portion of the tool but still attached by a friction seal as it overlaps the end of the tool by approximately 0.375 inches. The hole in the vinyl is oriented upward. This location of the vinyl exposes the hole in the vinyl to the cavity portion at the end of the barrel insert 41. The user places the tip of a non-battery powered light gathering device into the hole and angles it toward the already located, gun barrel tip. The light gathering device lights up the barrel interior without allowing the fluids to drip or to contact unwanted places.

Figure 15:
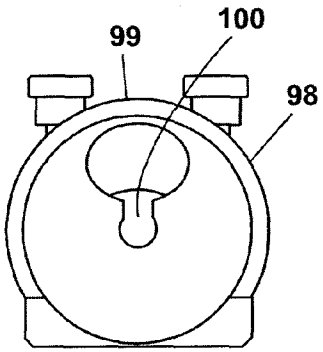
FIG. 15 is an end view illustrating additional features implementable in gun cleaning tools constructed according to the illustrative embodiments.

FIG. 14 illustrates an extended guide 97 formed at the brush receiving end of the tool sized to receive a rubber cap to close the end of the tool 11 during transit or storage. FIG. 15 illustrates an alternative end cap 98 which permits the wire brush 21 to be inserted through a large opening 99 whereafter, the rod 19 is moved downwardly into a much narrower guide hole 100, which serves to provide additional guidance for the rod 19 and brush 21 during reciprocating cleaning operations, while at the same time preventing the brush 21 from exiting the rear of the tool.

Prior to using the gun barrel cleaning apparatus of the illustrative embodiments of FIGS. 1-12, a number of preliminary or preparatory steps are taken. First, an open jar of cleaning solvent, such as Hoppes No. 9 Solvent, and a bottle of oil are set out on a work bench or other suitable surface, along with five to twenty cleaning patches comprising 2 inch square, white, pieces of cloth type material. A number of additional items are then collected:

(a) A suitable main rod 19 of the correct length that has a swivel type bearing in the T-handle 17;

(b) A bristle 21 that is the correct diameter for the bore or barrel size to be cleaned;

(c) A loop type rod that screws into the end of the main rod when the bristle is removed, and (d) An eye dropper.

The loop type rod is like the eye of a needle only somewhat larger. A white cloth cleaning patch can be inserted through the loop, but does not easily pull out when drawn through a gun barrel. Once these items are set out, the bristle 21 is screwed onto the rod 19.

To use the tool 11, it may first be cradled in the left hand. The thumb screws 55, 57 are unscrewed until they clear the top of the rails 28, 30. The brush guide 23 is then pulled to the extended ("open") position with the right hand. The guide 23 is allowed to drop to approximately a 90 degree angle, as shown in FIG. 1, while the left hand balances the tool 11 and generally holds it flat in the palm of the left hand.

When the barrel holder 21 is cradled in the user's left hand and the brush guide 23 is in the open and pivoted down position, the user then uses his right thumb and fingers to slide the barrel insert 41 into the hole until the tab 93 stops against the front edge of 21. Additionally, the insert tab 93 (FIG. 13) lines up with a threaded hole in the front of the face of the barrel holder 21. Screw 94 is then inserted and threaded to a stop, pinching the tab portion between the screw head and the barrel holder. This pinching captures the barrel insert 41 and keeps the barrel insert 41 from moving fore or aft.

The gun barrel 13 is then placed into the barrel holder end 21 of the tool 11 by using the thumb and finger of the right hand to grip the chamber end of the barrel 13 and to direct the tip of the barrel, i.e., the "crown" into the barrel insert 41. The barrel is then pushed forward until it stops against the shoulder 40 of the barrel insert 41. The shoulder is generally two thirds of the way back from the crown on most barrel designs.

Figure 5:
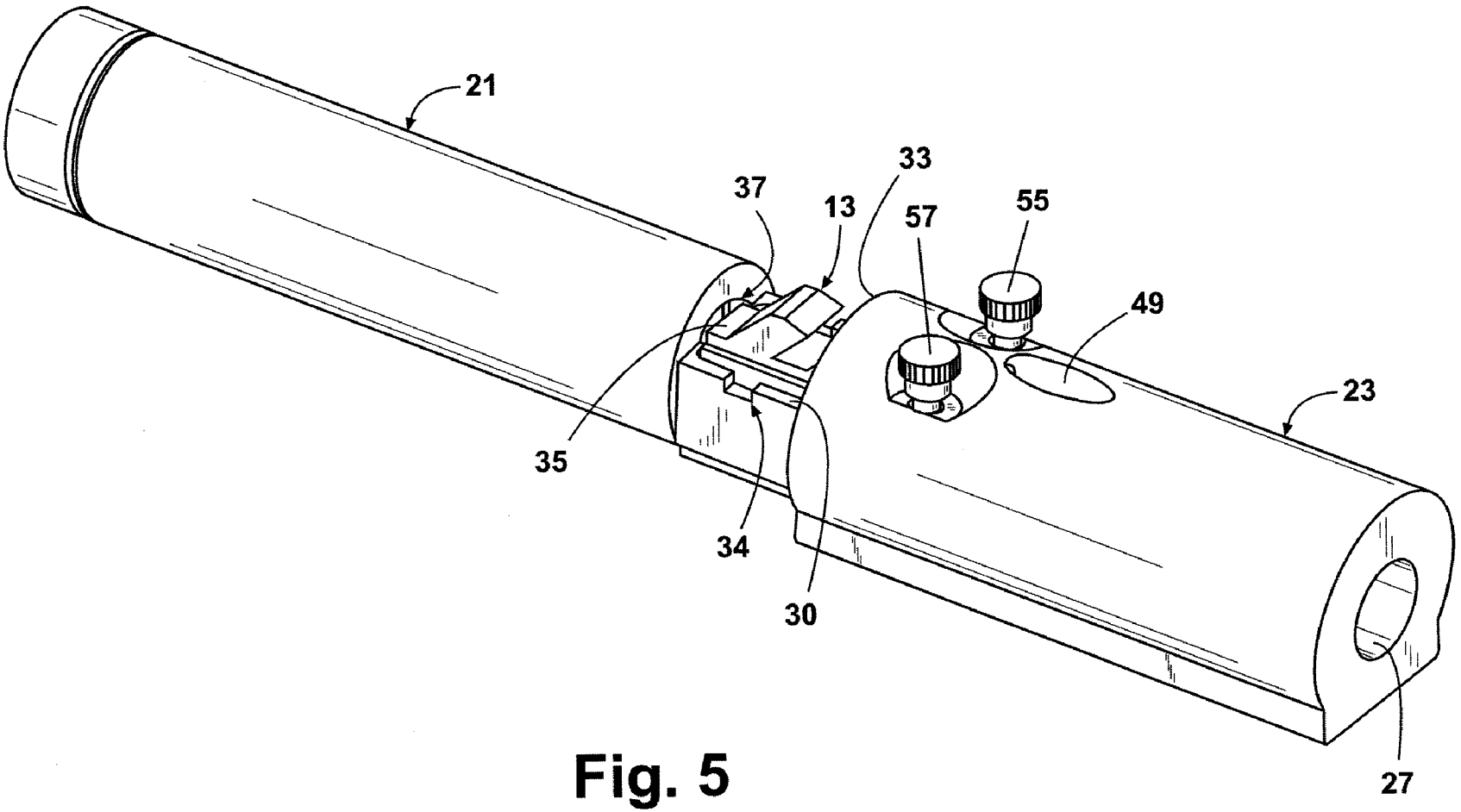
FIG. 5 is a perspective sectional view of the device of FIG. 2 in a partially closed position corresponding to the position of FIG. 4.

With the barrel now in the barrel insert 41 and shouldered against the soft silicone or urethane material, the brush guide 23 is lifted and drawn level with the rest of the tool 11, and then moved forward until it contacts the barrel 13, as shown in FIG. 5. In this position, the bonnet 33 or shoulder formed as part of the brush guide extends over approximately the first ⅜ of an inch of the barrel 13, which enables the bonnet 33 to control spray from the solvent soaked bristle 21 as it moves back and forth through the barrel 13. The user then tightens the knobs 55, 57, pinching the "U" shaped portion of the barrel holder to prevent it from sliding.

Still holding the tool in the left palm, the user then tilts the tool 11 slightly lower towards the bottle end, and places the bristle tipped rod 19 into the cone shaped end 27 of the brush guide 23. Due to its size, the bristle 21 will not travel through the barrel by gravity alone, and hence is stopped at the chamber end of the barrel, resulting in the bristle being positioned under the tunnel 47 that is designed to route the fluid to the top of the bristle 21.

The user then takes the eye dropper in the right hand, draws up solvent, places the eyedropper into the eyedropper channel 47, and squeezes, causing the cleaning fluid to move onto the bristle 21. The bristle 21 is then plunged back and forth through the barrel until 4 or 5 passes are completed. The user then stops the bristle 21 at the entrance to the chamber and squeezes more solvent onto the bristle and continue the reciprocating cleaning action until cleaning is complete. Due to construction of the device the rod 19 remains centered in the tool 11 during this reciprocating cleaning action and hence does not contact or damage the end or "crown" of the gun barrel 13.

Inspection of the barrel to determine when to discontinue cleaning is accomplished by looking through the barrel, which can be done in several ways. One way is to remove the rod 19 and bristle 21, and the bottle end 25, and look through the barrel while it is still in the barrel insert 41. Alternatively, the brush guide 23 can be drawn back and down to position shown in FIG. 1, the barrel removed and held up to a light. If more cleaning is necessary, the barrel can be placed back into the tool 11 and the cleaning process repeated as necessary. Excess cleaner fluid passes by gravity feed through the tool 11 and into the reservoir 25.

At this point, with the barrel still mounted in the device, after complete cleaning, the bristle 21 is removed and a needle type white patch holder is screwed onto the rod. A white patch is slipped into the a patch holder. The dry patch is passed through the barrel a couple of times, removing excess solvent. A new patch is inserted into the needle type rod attachment and 4 to 6 drops of oil are squirted onto the new white patch. The patch is drawn several times through the barrel. The process is repeated if the user feels it is necessary. The barrel is then removed from the device, and the outside of the barrel is wiped off to remove excess solvent. Some users like to wipe down the outside surfaces of the barrel with a small amount of oil.

Figure 16:
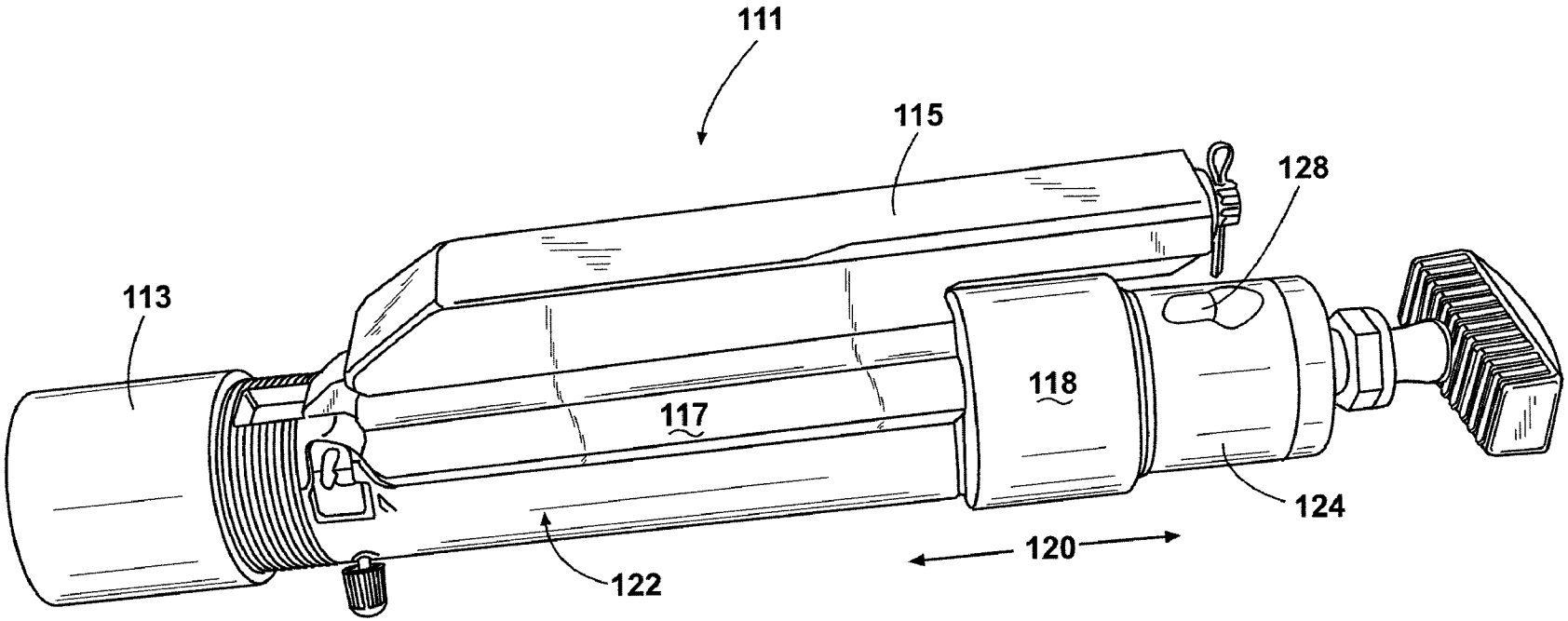
FIG. 16 is a perspective view of an alternate gun barrel cleaning tool embodiment.

An alternative gun barrel cleaner tool embodiment 111 is shown in FIGS. 16-20. This embodiment entirely encapsulates the gun barrel being cleaned. The tool 111 of FIG. 16 is generally cylindrical and includes a cylindrical fluid reservoir 113 which threads on at one end and a handle 115 integrally formed with a hinged cover 117. The cover sealably mates with a lower half section 122. The seal may be provided by a close mechanical fit or by a rubber or other seal component. As in the embodiment of FIG. 1, suitable interior chambers are provided within the tool 111 to guide the cleaning brush 21.

A collar 118 is threadably mounted on a rear portion 124 of the tool 111 and is moveable back and forth along the tool's axis as indicated by arrow 120. The collar 118 threads on to the handle 115 to hold the handle 115 in the closed position shown in FIG. 16. In this connection, as the handle 118 rotates and nears the "most forward position" it engages a receiving "ramp" formed at the right most end of the cover 117. The tightening of the collar 118 as it engages over the ramp forces the handle 115 and cover 117 downward. This downward pressure squeezes the barrel-receiving sleeve 119 (FIG. 17) around the gun barrel 13, which keeps the barrel from moving while it experiences the agitating back and forth motion of the bristle.

Figure 17:
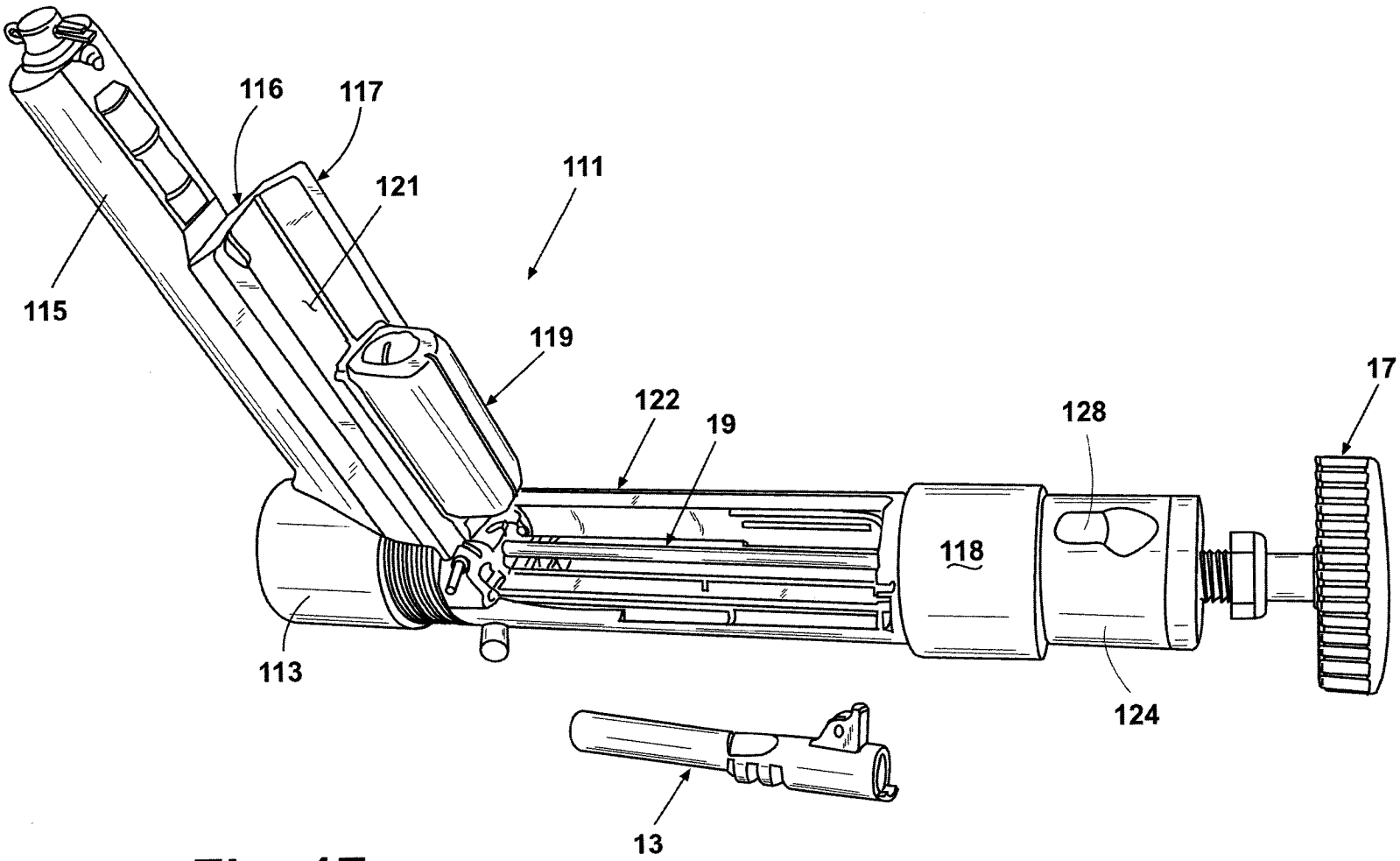
FIG. 17 is a perspective view of the tool of FIG. 16 in an open position.
Figure 18:
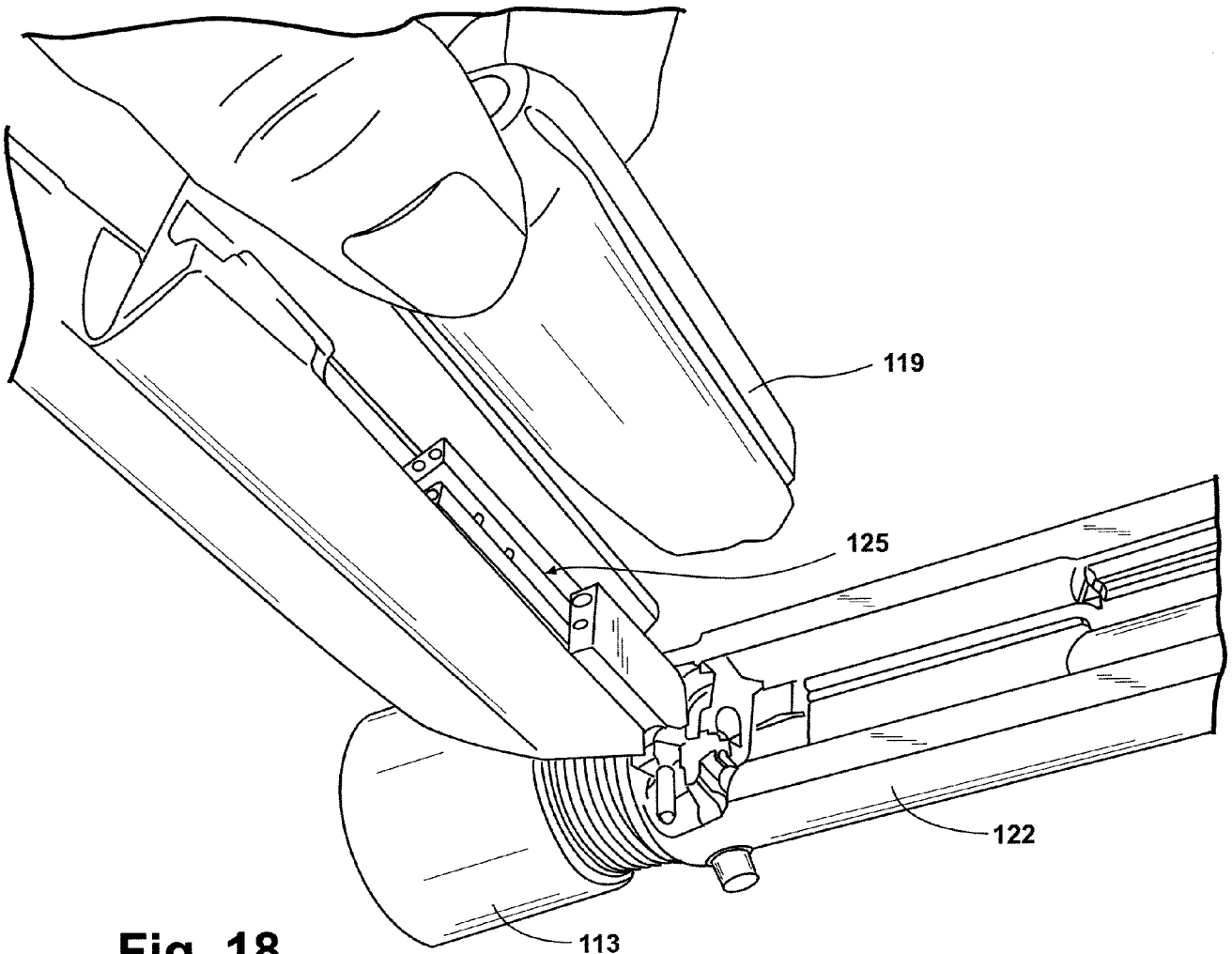
FIG. 18 is a perspective view illustrating a mechanism for retaining the gun barrel sleeve of the embodiment of FIG. 16.

As shown in FIG. 17, the handle 115 may be raised to open the tool 111 and reveal a barrel-receiving sleeve 119 removably attached to the inside surface 121 of the handle cover 117. As shown in FIG. 18, this removable attachment may be achieved by a dovetail fit between a V-shaped portion of the sleeve 119 and a cooperating V-shaped slot in a member 125 attached to the inside surface 121 of the cover 117. The sleeve 119 may be made of a spongy relatively compressible material such as urethane, rubber or silicone of shore 75. The sleeve 119 has a slot, e.g. ⅛" wide, along its bottom edge. A complementarily shaped cradle is located in the lower half section 122 to assist in squeezing the sleeve 119 when the handle 15 is lowered.

Figure 19:
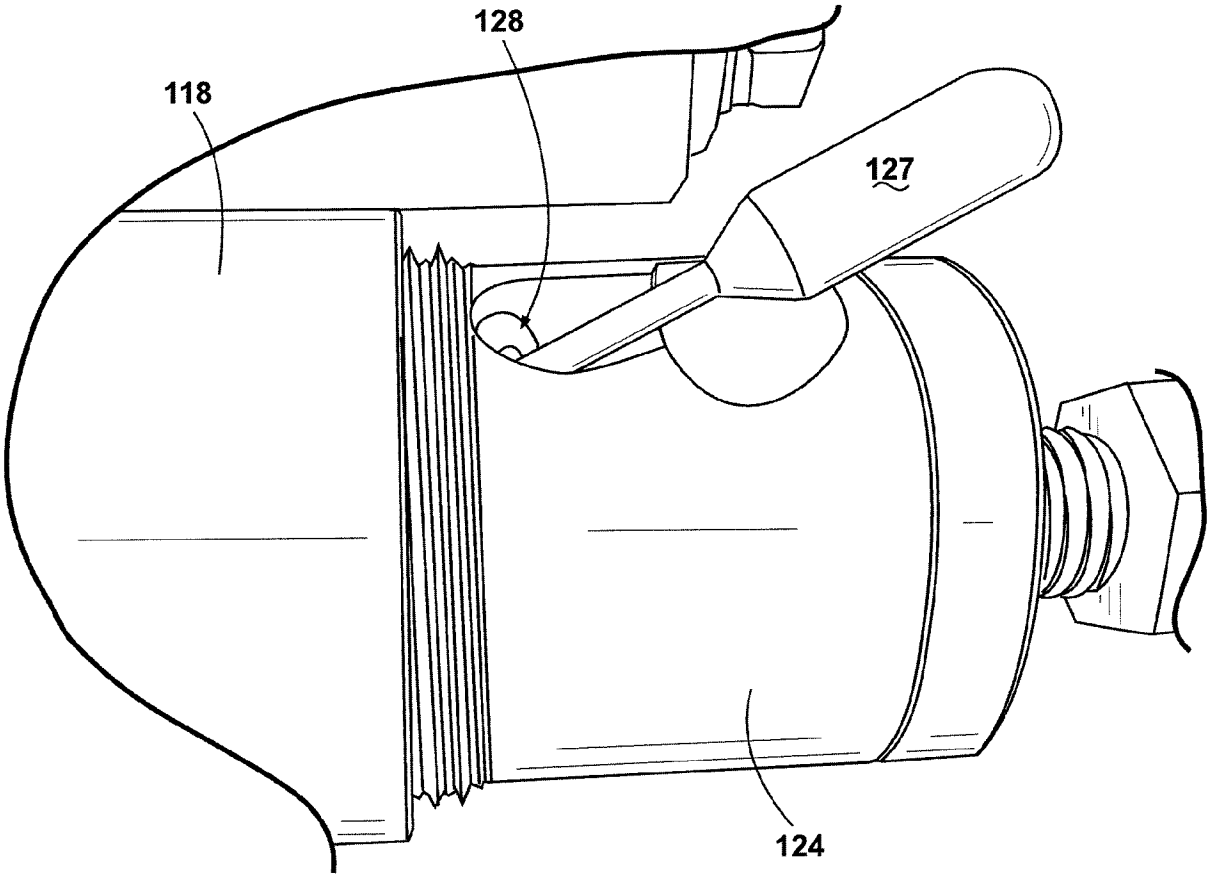
FIG. 19 is a perspective view of the brush-receiving end of the embodiment of FIG. 16.

Once a gun barrel is inserted into the sleeve 119, and the sleeve 119 is attached to the inside surface 121, the handle 115 is lowered to the closed position, and the collar 118 is rotated so as to move it forward, clamping down on the handle 115 so as to tightly close the device 111 to thereby hold the barrel 13 in place. Thereafter, the gun barrel may be cleaned in the manner described above, including the insertion of cleaning fluid via an eyedropper 127 inserted into opening 128 as shown in FIG. 19.

Figure 20:
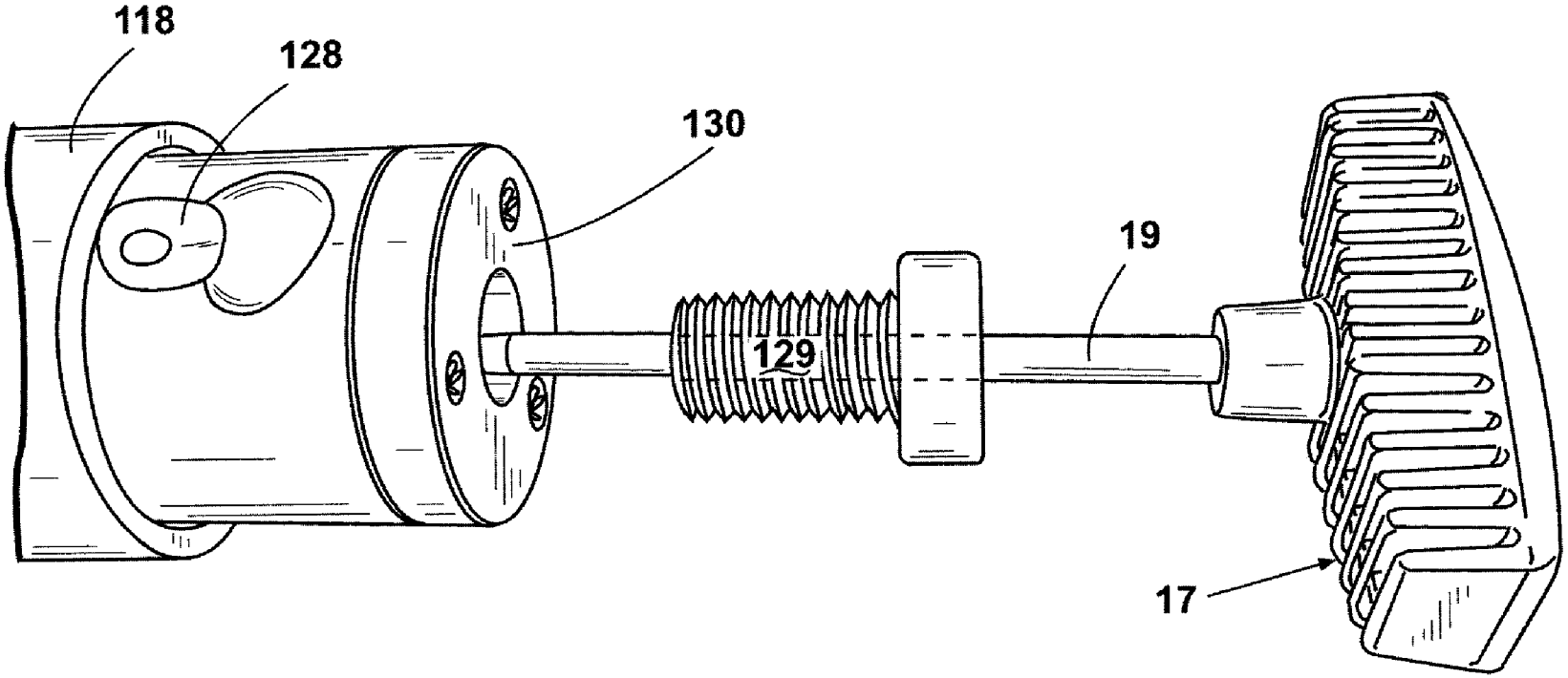
FIG. 20 is a perspective view illustrating a threaded brush receiving plug.

FIG. 20 illustrates an additional guide feature incorporated into the alternate embodiment, which could also be utilized in various other embodiments. This feature comprises a threaded plug 129, which threads into the brush receiving end 130 of the device. The plug 129 has a central hole formed therethrough, which is of a diameter just wide enough to slidably pass the rod 19 of the cleaning tool. In operation, the rod 19 is inserted through the central hole, and the wire brush 21 is then attached. The plug 129 is then screwed into the brush-receiving end 130. Thereafter, plug 129 prevents the brush from coming out of the tool as it is reciprocated back and forth through the gun barrel during cleaning operations.

Figure 21:
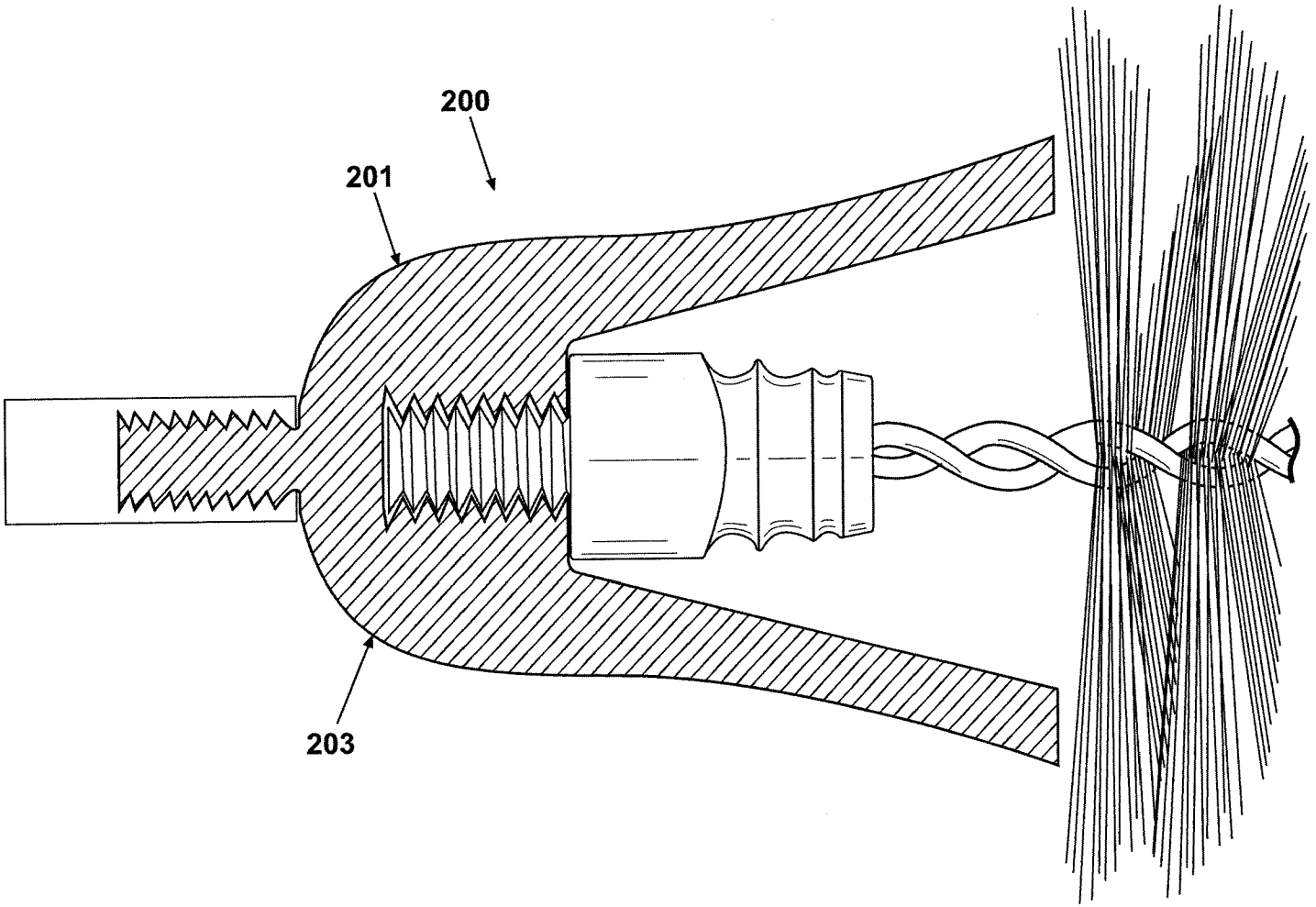
FIG. 21 is a side sectional view illustrating an embodiment of a gun barrel protecting apparatus.

When the rod is drawn all the way to the rear (or when the T handle 17 located farthest away from the device), the stop as described, may damage the bristles because they act as a stop. The stop design in FIG. 21 has a stand off numbered 200 that has a rounded bulge (201, 203) that may also be used in cleaning rifles. This "bulging" stop protects the tip of long rifle barrels. Rifle users would use only the stop and screw it onto the three foot long rods they already use in order to protect the crown of the rifle barrel when the bristle "drops" as it exits the end of the rifle barrel.

An alternative to the above described stop is to use a very small (outer diameter) washer which is slipped over the male end of the bristle before it is threaded into the rod. The approximate outer diameter of the washer would be 0.230 inches with an inner diameter to accept the standard thread pitch on most rods which is 8-32 per inch. Further this 0.230 diameter washer would interfere with the 0.200 inch diameter guide hole in the cap that is referred to in FIG. 14 as "100." This interference stops the bristles from hitting the cap and therefore prevents damage to the bristles and extends the life of the bristles.

Figure 24:
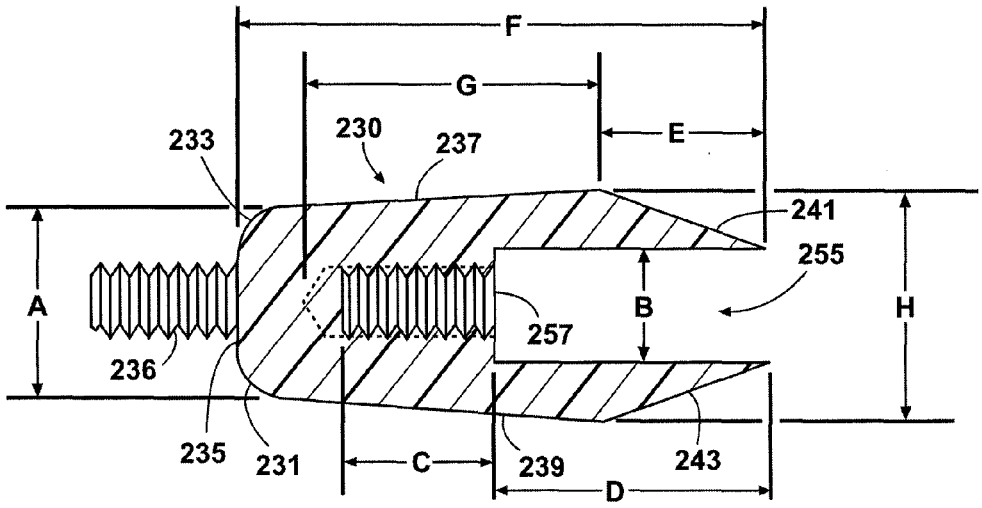
FIG. 24 and 25 are side sectional views of a barrel protecting device.
Figure 25:
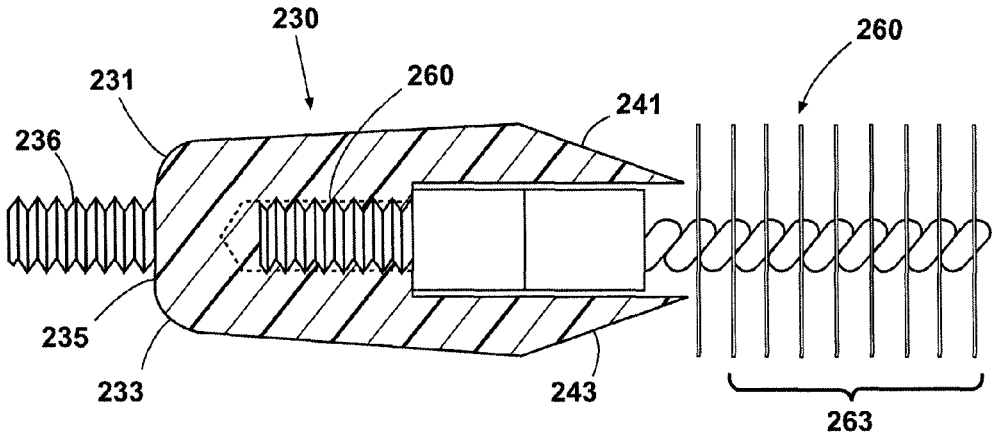

Another barrel protector embodiment 230 is shown in FIGS. 24 and 25. This protector includes rounded rear corners 231, 233, leading into a vertical surface 235 from which extends a threaded stud 236 for attachment to a cleaning rod. The side segments 237, 239 of the protector 230 flare outwardly slightly from the corners 231, 233 and terminate in inwardly directed sides segments 241, 243. A central cylindrical opening 255 ends in a threaded opening 257.

As shown in FIG. 23, the threaded end 260 of a cleaning brush 261 enters the opening 255 and threads into the threaded opening 257. The brush 261 includes bristles 263. Illustrative dimensioning of one embodiment in inches is as follows:

| |
|---|
| A = .375 |
| B = .218 |
| C = .282 |
| D = .518 |
| E = .313 |
| F = 1.000 |
| G = .875 |
| H = .400 |

The inwardly directed side segments 241, 243 may lie at angle of 30 degrees to the horizontal in one embodiment, while the side segments 237, 239 may be at an angle of eight degrees to the horizontal. These angles may vary in various other embodiments. In one embodiment, the protector 230 is preferably circular in cross-section such that a cross-section perpendicular to the horizontal axis of the device at any point along that axis yields a cross-section with a circular outer perimeter. The design of FIG. 21 may have the same circular cross-section. The protector may be fabricated of various plastics, Nylon, soft metals or a coated harder metal such as aluminum.

A number of advantages accrue from use of a gun barrel cleaning device according to the illustrative embodiments. First, the process is rapid, hands are kept clean and the proper amount of fluid is used. Too little fluid causes excessive wear on an expensive precision machined barrel, while too much wastes money.

Another advantage is that the accuracy of the barrel is not compromised. The barrel is protected from damage during the cleaning process including damage from accidental drop or other impact, damage at the tip (crown), or damage to the precision machined inner diameter. Barrel life is also extended.

The process is also much cleaner and safer. Hands do not have copper bristles embedded, and bristle life is extended. There is also no solvent smell, no copper residue, no lead residue and no gun powder residue embedded in pores of skin, and no solvent spray or drips to contaminate footwear or clothing. The solvent collected in the fluid reservoir can be disposed of properly.

Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A gun barrel cleaning apparatus comprising:

a barrel holder having a first interior chamber for receiving a gun barrel, said first interior chamber having a first opening on an inner side of said barrel holder;

a sleeve shaped and dimensioned to be insertable into said first interior chamber through said first opening, said sleeve further having an interior opening shaped to receive and hold at least a first portion of a gun barrel inserted into said barrel holder through said first opening;

a brush guide having inner and outer ends and slideably mounted to said barrel holder so as to be movable toward the inner end of said barrel holder into a closed position after insertion of a gun barrel into said barrel holder, said brush guide having a second interior chamber having an opening on the inner end thereof aligned with the first opening of said first interior chamber of said barrel holder, said brush guide further having an opening in the outer end thereof permitting insertion of a barrel cleaning tool into and through said first and second interior chambers and through a gun barrel disposed in a said sleeve positioned in said first interior chamber; and wherein said brush guide is further hingedly mounted to said barrel holder such that as said brush guide moves away from the closed position to an open position, the brush guide pivots or drops downward with respect to the barrel holder.

2. The gun barrel cleaning apparatus of claim 1 further comprising:

a fluid reservoir removably attached at an end of said barrel holder.

3. A gun barrel cleaning apparatus comprising:

a barrel holder having a first interior chamber and a cradle portion located behind said first interior chamber, said first interior chamber having an open end which opens into said cradle portion, said cradle portion having respective sides and an open top;

a sleeve shaped and dimensioned to be insertable into said first interior chamber through said open end of said chamber, said sleeve having an interior opening therein, said interior opening being adapted to receive and hold a gun barrel;

wherein said cradle is shaped such that a gun barrel may be inserted into said cradle, through said open end and then into a said sleeve positioned in said interior chamber; and a brush guide slideably mounted to said barrel holder so as to be moveable either toward or and away from said barrel holder and being shaped and dimensioned to come into a first position wherein said brush guide covers an end portion of a gun barrel resting in said cradle as said brush guide is moved toward said barrel holder; and wherein said brush guide is further hingedly mounted to said barrel holder such that as said brush guide moves away from the closed position to an open position, the brush guide pivots or drops downward with respect to the barrel holder.

4. The gun barrel cleaning apparatus of claim 3 wherein the sleeve is formed of a plastic of a softness selected so as not to scratch a gun barrel.

5. The gun barrel cleaning apparatus of claim 3 further comprising:

a tongue extending from said cradle and having a pin projecting from either side thereof; and wherein said brush guide has first and second horizontally disposed slots which mate with said pins, said slots being shaped and dimensioned to achieve pivotal mounting of said brush guide to said barrel holder.

6. The gun barrel cleaning apparatus of claim 3 further comprising respective slots formed on either side of said cradle and respective pins positioned on an interior of said brush guide to mate respectively with said slots, said slots being further shaped and dimensioned to enable said brush guide to move toward and away from said barrel holder and to pivot or drop down with respect to said barrel holder when said brush guide is moved away from said barrel holder to a selected position.

7. The gun barrel cleaning apparatus of claim 3 wherein the brush guide comprises a bonnet portion at an end thereof which overlaps said gun barrel when said brush guide comes into said first position.

8. The apparatus of claim 3 further comprising:

a fluid reservoir removably attached at one end of said barrel holder.

9. The gun barrel cleaning apparatus of claim 3 wherein the first interior chamber of said barrel holder is cylindrical and wherein said barrel holder has a second interior cylindrical chamber concentric with the first interior chamber and of a diameter larger than the first interior chamber.

10. The gun barrel cleaning apparatus of claim 9 wherein the length of the sleeve is selected such that the sleeve extends into said second interior chamber and has an end which extends beyond an end of a gun barrel located therein.

11. The gun barrel cleaning apparatus of claim 10 wherein the sleeve is formed of a plastic of a softness selected so as not to scratch a gun barrel.

12. A gun barrel cleaning apparatus comprising:

a barrel holder having a first interior chamber and a cradle portion located behind said first interior chamber, said first interior chamber having an open end which opens into said cradle portion, said cradle portion having respective sides and an open top;

a sleeve shaped and dimensioned to be insertable into said first interior chamber through said open end of said chamber, said sleeve having an interior opening therein., said interior opening being adapted to receive and hold a gun barrel;

wherein said cradle is shaped such that a gun barrel may be inserted into said cradle, through said open end and then into a said sleeve positioned in said interior chamber;

a brush guide slideably mounted to said barrel holder so as to be moveable either toward or and away from said barrel holder and being shaped and dimensioned to come into a first position wherein said brush guide covers an end portion of a gun barrel resting in said cradle as said brush guide is moved toward said barrel holder; and wherein the first interior chamber of said barrel holder is cylindrical and wherein said barrel holder has a second interior cylindrical chamber concentric with the first interior chamber and of a diameter larger than the first interior chamber.

13. The gun barrel cleaning apparatus of claim 12 wherein the length of the sleeve is selected such that the sleeve extends into said second interior chamber and has an end which extends beyond an end of a gun barrel located therein.

14. The gun barrel cleaning apparatus of claim 13 further comprising:

a fluid reservoir removably attached at an end of said barrel holder.

15. A gun barrel cleaning apparatus comprising:

a barrel holder having a first interior chamber and a cradle portion located behind said first interior chamber, said first interior chamber having an open end which opens into said cradle portion, said cradle portion having respective sides and an open top;

a sleeve shaped and dimensioned to be insertable into said first interior chamber through said open end of said chamber, said sleeve having an interior opening therein, said interior opening being adapted to receive and hold a gun barrel;

wherein said cradle is shaped such that a gun barrel may be inserted into said cradle, through said open end and then into a said sleeve positioned in said interior chamber; and a brush guide slideably mounted to said barrel holder so as to be moveable either toward or and away from said barrel holder and being shaped and dimensioned to come into a first position wherein said brush guide covers an end portion of a gun barrel resting in said cradle as said brush guide is moved toward said barrel holder; and wherein the brush guide comprises first and second parallel slots shaped to slideably mate with the respective sides of said cradle so as to enable the brush guide to slideably move toward and away from said barrel holder.

16. The gun barrel cleaning apparatus of claim 15 wherein the first interior chamber of said barrel holder is cylindrical and wherein said barrel holder has a second interior cylindrical chamber concentric with the first interior chamber and of a diameter larger than the first interior chamber.

17. The gun barrel cleaning apparatus of claim 16 wherein the length of the sleeve is selected such that the sleeve extends into said second interior chamber and has an end which extends beyond an end of a gun barrel located therein.

18. The gun barrel cleaning apparatus of claim 17 wherein the sleeve is formed of a plastic of a softness selected so as not to scratch a gun barrel.

19. A gun barrel cleaning apparatus comprising:

a barrel holder having a first interior chamber and a cradle portion located behind said first interior chamber, said first interior chamber having an open end which opens into said cradle portion, said cradle portion having respective sides and an open top;

a sleeve shaped and dimensioned to be insertable into said first interior chamber through said open end of said chamber, said sleeve having an interior opening therein, said interior opening being adapted to receive and hold a gun barrel;

wherein said cradle is shaped such that a gun barrel may be inserted into said cradle, through said open end and then into a said sleeve positioned in said interior chamber; and a brush guide slideably mounted to said barrel holder so as to be moveable either toward or and away from said barrel holder and being shaped and dimensioned to come into a first position wherein said brush guide covers an end portion of a gun barrel resting in said cradle as said brush guide is moved toward said barrel holder; and further comprising respective slots formed on either side of said cradle and respective pins positioned on an interior of said brush guide to mate respectively with said slots, said slots being further shaped and dimensioned to enable said brush guide to move toward and away from said barrel holder and to pivot or drop down with respect to said barrel holder when said brush guide is moved away from said barrel holder to a selected position.

20. The gun barrel cleaning apparatus of claim 19 wherein the first interior chamber of said barrel holder is cylindrical and wherein said barrel holder has a second interior cylindrical chamber concentric with the first interior chamber and of a diameter larger than the first interior chamber.

21. The gun barrel cleaning apparatus of claim 20 wherein the length of the sleeve is selected such that the sleeve extends into said second interior chamber and has an end which extends beyond an end of a gun barrel located therein.

22. The gun barrel cleaning apparatus of claim 21 wherein the sleeve is formed of a plastic of a softness selected so as not to scratch a gun barrel.

23. The gun barrel cleaning apparatus of claim 22 wherein the sleeve is formed of a plastic of a softness selected so as not to scratch a gun barrel.

24. The gun barrel cleaning apparatus of claim 20 wherein the length of the sleeve is selected such that the sleeve extends into said second interior chamber and has an end which extends beyond an end of a gun barrel located therein.

25. The gun barrel cleaning apparatus of claim 24 wherein the sleeve is formed of a plastic of a softness selected so as not to scratch a gun barrel.

26. A gun barrel cleaning apparatus comprising:

a barrel holder having a first interior chamber and a cradle portion located behind said interior chamber, said cradle portion having respective sides and an open top;

a sleeve shaped and dimensioned to be insertable into said interior chamber through an end of said chamber nearest said cradle, said sleeve being adapted to receive and hold a gun barrel;

wherein said cradle is shaped such that a gun barrel may be inserted into said cradle, and then into a said sleeve positioned in said interior chamber;

a brush guide having a second interior chamber; and means for attaching said brush guide to said barrel holder and for enabling said brush guide to move either towards said barrel holder or away from said barrel holder; and wherein said attaching and enabling means further enables said brush guide to pivot or drop downwardly with respect to said barrel holder after said brush guide has been moved a selected distance away from said barrel holder.

27. The gun barrel cleaning apparatus of claim 26 wherein said attaching and enabling means comprises:

a tongue extending from said cradle and having a pin projecting from either side thereof; and first and second horizontally disposed slots on said brush guide which mate with said pins, said slots being shaped and dimensioned to achieve pivotal mounting of said brush guide to said barrel holder.

28. The gun barrel cleaning apparatus of claim 26 wherein said attaching and enabling means comprises respective slots formed on either side of said cradle and respective pins positioned on an interior of said brush guide to mate respectively with said slots, said slots being further shaped and dimensioned to enable said brush guide to move toward and away from said barrel holder and to pivot or drop down with respect to said barrel holder when said brush guide is moved a selected distance away from said barrel holder.

29. The gun barrel cleaning apparatus of claim 26 further comprising:

a fluid reservoir removably attached at an end of said barrel holder.

30. The gun barrel cleaning apparatus of claim 26 wherein the first interior chamber of said barrel holder is cylindrical and wherein said barrel holder has a second interior cylindrical chamber concentric with the first interior chamber and of a diameter larger than the first interior chamber.

31. The gun barrel cleaning apparatus of claim 30 wherein the length of the sleeve is selected such that the sleeve extends into said second interior chamber and has an end which extends beyond an end of a gun barrel located therein.

32. A gun barrel cleaning apparatus comprising:

a barrel holder having a first interior chamber and a cradle portion located behind said interior chamber, said cradle portion having respective sides and an open top;

a sleeve shaped and dimensioned to be insertable into said interior chamber through an end of said chamber nearest said cradle, said sleeve being adapted to receive and hold a gun barrel;

wherein said cradle is shaped such that a gun barrel may be inserted into said cradle, and then into a said sleeve positioned in said interior chamber;

a brush guide having a second interior chamber; and means for attaching said brush guide to said barrel holder and for enabling said brush guide to move either towards said barrel holder or away from said barrel holder; and wherein said attaching and enabling means comprises first and second parallel slots shaped to slideably mate with the respective sides of said cradle.

33. The gun barrel cleaning apparatus of claim 32 wherein the first interior chamber of said barrel holder is cylindrical and wherein said barrel holder has a second interior cylindrical chamber concentric with the first interior chamber and of a diameter larger than the first interior chamber.

* * * * *